US007584968B2

(12) United States Patent
Campbell et al.

(10) Patent No.: US 7,584,968 B2
(45) Date of Patent: Sep. 8, 2009

(54) POKER GAME AND APPARATUS FOR PLAY THEREOF

(75) Inventors: Darrell Campbell, Buffalo Gap, SD (US); David J. Richards, Las Vegas, NV (US); Spencer Peterson, Henderson, NV (US)

(73) Assignee: Seven Generations, Inc., Buffalo Gap, SD (US)

( * ) Notice: Subject to any disclaimer, the term of this patent is extended or adjusted under 35 U.S.C. 154(b) by 28 days.

(21) Appl. No.: 11/709,486

(22) Filed: Feb. 22, 2007

(65) Prior Publication Data

US 2007/0241508 A1 Oct. 18, 2007

Related U.S. Application Data

(63) Continuation-in-part of application No. 11/404,572, filed on Apr. 14, 2006.

(51) Int. Cl.
*A63F 1/00* (2006.01)
*A63F 3/08* (2006.01)

(52) U.S. Cl. ..... 273/292; 273/309; 463/13; 463/46

(58) Field of Classification Search ..... 273/292, 273/274, 309, 138.2; 463/13, 12, 46
See application file for complete search history.

(56) References Cited

U.S. PATENT DOCUMENTS

| | | | |
|---|---|---|---|
| 3,663,021 | A | 5/1972 | Whippo |
| 4,305,586 | A | 12/1981 | Richards |
| 4,397,469 | A | 8/1983 | Carter, III |
| 4,440,398 | A | 4/1984 | Charon |
| 4,614,342 | A | 9/1986 | Takashima |
| 4,648,604 | A | 3/1987 | Horan |
| 4,651,997 | A | 3/1987 | Wood |
| 4,836,553 | A | 6/1989 | Suttle et al. |
| 4,861,041 | A | 8/1989 | Jones et al. |
| 4,948,134 | A | 8/1990 | Suttle et al. |
| 5,265,882 | A | 11/1993 | Malek |
| 5,368,305 | A | 11/1994 | Rodda et al. |
| 5,403,015 | A | 4/1995 | Forte et al. |
| 5,518,249 | A | 5/1996 | Sines et al. |
| 5,554,892 | A | 9/1996 | Norimatsu |
| 5,586,766 | A | 12/1996 | Forte et al. |
| 5,657,993 | A | 8/1997 | Merlino et al. |
| 5,685,774 | A | 11/1997 | Webb |
| 5,788,230 | A | 8/1998 | Krise et al. |
| 5,816,916 | A | 10/1998 | Moody |
| 5,820,128 | A | 10/1998 | Brunelle |

(Continued)

*Primary Examiner*—Benjamin H Layno
(74) *Attorney, Agent, or Firm*—Gordon & Rees LLP

(57) ABSTRACT

A poker card game and apparatus and software for its play are disclosed, particularly adapted for casino play, in which each player in a given game, using only a single dealt hand, plays simultaneously separately against the dealer (the house) and against the other players. Betting for the two lines of play may be separate or linked, and a player can elect to play only against the dealer or to play both games together. The game is played as a form of five-card stud with betting before each deal. At the end of each game a player's status as to whether he/she beat the dealer, beat the other players or both is determined and displayed, and winners are paid accordingly. Conventional dealing may be used, but it is preferred that a biased deal, which enhances the opportunities for players to be dealt reasonably good poker hands, be used.

52 Claims, 16 Drawing Sheets

U.S. PATENT DOCUMENTS 5,823,873 A 10/1998 Moody
5,839,732 A 11/1998 Guidi
5,845,211 A 12/1998 Roach, Jr.
5,845,907 A 12/1998 Wells
5,901,958 A 5/1999 Andrews
5,928,082 A 7/1999 Clapper, Jr.
5,934,672 A 8/1999 Sines et al.
5,934,998 A 8/1999 Forte et al.
5,951,011 A 9/1999 Potter et al.
5,997,002 A 12/1999 Goldman
6,015,347 A 1/2000 Maahs et al.
6,019,374 A 2/2000 Breeding
6,029,976 A 2/2000 Brunelle
6,056,641 A 5/2000 Webb
6,089,976 A 7/2000 Schneider et al.
6,102,400 A 8/2000 Scott et al.
6,102,402 A 8/2000 Scott et al.
6,102,403 A 8/2000 Kaufman
6,105,964 A 8/2000 Maahs
6,158,741 A 12/2000 Koelling
6,164,069 A 12/2000 Takahashi et al.
6,165,069 A 12/2000 Sines et al.
6,179,290 B1 1/2001 Maahs
6,189,888 B1 2/2001 Brunelle
6,196,547 B1 3/2001 Pascal et al.
6,203,009 B1 3/2001 Sines et al.
6,210,277 B1 4/2001 Stefan
6,229,534 B1 5/2001 Gerra et al.
6,237,916 B1 5/2001 Webb
6,270,079 B1 8/2001 Chamberlain
6,270,404 B2 8/2001 Sines et al.
6,270,405 B1 8/2001 Ferguson
6,299,532 B1 10/2001 Smith
6,325,375 B1 12/2001 Potter et al.
6,334,614 B1 1/2002 Breeding
6,345,823 B1 2/2002 Webb
6,402,147 B1 6/2002 Lo
6,406,024 B1 6/2002 Perkins
6,419,225 B2 7/2002 Sines et al.
6,419,226 B2 7/2002 Krise et al.
6,435,506 B1 8/2002 Piccoli
6,446,972 B1 9/2002 Brunelle
6,481,718 B2 11/2002 Koelling
6,517,073 B1 2/2003 Vancura
6,575,466 B1 6/2003 Lizak
6,588,758 B1 7/2003 Lee
6,607,195 B2 8/2003 Vancura
6,619,659 B2 9/2003 Krise et al.
6,641,137 B2 11/2003 Sines et al.
6,644,666 B1 11/2003 Tamura et al.
6,651,985 B2 11/2003 Sines et al.
6,698,759 B2 3/2004 Webb et al.
6,722,974 B2 4/2004 Sines et al.
6,773,012 B1 8/2004 French
6,800,028 B1 10/2004 Paludi
6,802,774 B1 10/2004 Carlson et al.
6,857,957 B2 2/2005 Marks et al.
6,923,446 B2 8/2005 Snow
6,938,900 B2 9/2005 Snow
7,048,629 B2 5/2006 Sines et al.
2003/0092475 A1 5/2003 Fox
2003/0092476 A1 5/2003 Fox

POKER GAME AND APPARATUS FOR PLAY THEREOF

CROSS-REFERENCE TO RELATED APPLICATION

This application is a continuation-in-part of application Ser. No. 11/404,572, filed on Apr. 14, 2006, of like title.

BACKGROUND OF THE INVENTION

The invention herein relates to table card games. More particularly it relates to poker games and apparatus used for the play thereof, and particularly adapted for use in casinos.

In the past there been numerous poker games played in the conventional manner in which the individual players play against each other and where the position of the dealer rotates among the players. Cardhouse/casino poker games may have a house dealer sit in to deal the cards but the dealer is not involved in the game itself, and the players still play only against each other. Conversely there are other games such as Caribbean poker in which each player plays only against the house dealer and the specific hand held by each of the players is of little consequence to the other players. Games in which a player can play simultaneously with a single hand against both a dealer and the other players are seldom found. However, such games are anticipated to be highly popular with players because the games give them the opportunity to have two winnings with each hand, one against the house dealer and the other against the other players.

Similarly, in the past there have been games which have been played with distorted decks of cards, such as games in which one or more cards, card values or card suites are removed from the deck before hands are dealt. Such games are not relevant to the present invention, since the playing of poker requires that all 52 cards be in the deck from which the hands are dealt, so that all of the possible card combinations expected by players in poker games are capable of being dealt from the deck in each hand. (The inclusion of one or two jokers as additional cards in the deck does not alter this requirement. The joker does not diminish the number of natural poker card combinations that can potentially be dealt from the deck, it merely increases the number of ways those combinations can be dealt.) While games utilizing such non-standard decks may be enjoyable to their players, they cannot be considered to be poker or relevant to poker.

There have also long been methods of dealing cards from a deck in sequences other than the randomized card order which follows a thorough shuffle of the deck. Among the most common of these distorted dealing sequences occurs when a dealer deals a card from the bottom of the deck or deals the second card in the deck rather than dealing the first card, i.e., the card on the top of the deck. By using such "crooked deals" dishonest dealers have intended to cheat other players in the card game, such as by providing one or more of the other players with poorer value hands than they would otherwise have had, or by providing a better value hand to one player (usually a confederate of the dealer or a shill for the house) than that player would otherwise have had, all in order to increase the winnings of the dealer, the confederate and/or the house. Since such forms of dealing are intended to cheat players in a game, they are of course also intended to be kept secret from the players who are being cheated. They are also uniformly considered illegal. Therefore, notwithstanding that such forms of dealing might theoretically be labeled as "biased," they are not relevant to the "biased deal" concept included in the present invention, where the purpose is to enhance the overall opportunities for all of the players in a poker game and the nature and presence of the biased dealing are known to all players and are considered by the players to be both essential and desired.

SUMMARY OF THE INVENTION

The invention herein is a unique poker card game, particularly adapted for casino play, in which each player in a given game, using only a single dealt hand, plays simultaneously separately against the dealer (the house) and against the other players. Betting for the two lines of play may be separate or may be linked, and a player can elect to play only against the dealer or to play both lines together. A player can fold against the other players without also folding against the dealer, but cannot fold against the dealer without thereby also folding against the other players.

The game is played as a form of five-card stud starting with an ante and an initial two-card deal face up to all players and the dealer, and progresses with subsequent one-card deals, also face up, with betting before each deal. At the end of each hand a player's status as to whether he/she beat the dealer, beat the other players or both, is determined and displayed, and winners are paid accordingly. Any or all of the players may be winners against the dealer. With respect to the players' pool pot, several alternatives are possible, and any one may be chosen or two or more combined for specific games at the selection of the house or of the players. The preferred alternative is that only the player with the highest ranking hand will win the pool pot, but only if that player also beats the dealer. Another alternative is that only the player with the highest ranking hand will win the pool pot, but that player need not also beat the dealer. Yet another alternative is that if no player beats the dealer on a hand, the money in the pot rolls over to the next hand and is incorporated into that hand's pot. Still another alternative is that two or more players share the pot, under conditions which may include whether or not one or more has also beaten the dealer on the hand, how the players' hands ranked compared to each other, and whether shares are to be equal or divided in accordance with predetermined ratios based on relative hand rankings. It will be evident that two or more of these alternatives may in some cases be combined, as long as the combination conditions are consistent. While the dealer does not bet into or otherwise participate in the players' pool pot, the casino or house may have a rake on that pot for a small percentage (often with a dollar amount cap) or a flat amount, which the dealer collects after the hand is completed but before the pot is distributed. The players' pool pot rake will be separate from amounts lost by the players when playing against the dealer.

Conventional dealing may be used, but it is preferred that a biased deal, which reduces the proportion of weak poker hands from that produced by normal non-biased deals and thereby enhances the opportunities for players to be dealt reasonably good poker hands, be used to encourage players to play complete hands (i.e., not fold during a hand).

While the game may be played manually with dealt cards laid face up on a poker table surface, the game is primarily intended to be played as an electronic casino game, using a specially configured table with computer monitors built into the table at the dealer's position and at each player's position. All of the monitors are connected to a central (usually dedicated) computer processing unit which may also be built into the table. The software which runs on the processing unit and operates the play of the game is controlled from the dealer's monitor which includes a touch screen controller. The players' monitors can also have touch screens to communicate with the processor, but usually only for the purpose of indicating that a player wishes to bet or fold prior to a deal. Preferably the players' monitors will be for viewing only and players will announce verbally at the table whether they are betting or folding prior to each deal, and after each player has verbally announced the dealer will enter any folds into the system via his/her touch screen and then activate the deal of the next card, also from the touch screen.

The game as designed has great attractiveness to players because of its ability to generate multiple winners on each hand. Each player has the chance on a single hand to be both a winner against the dealer (house) and also the players' pot winner. Multiple players can win on a single hand against the dealer. If the house or table rules permit, there can also be a variation where multiple players can split the players' pot. The use of a biased deal enhances the attractiveness, since all players can expect to be dealt hands that are good enough in ranking to be worth playing through an entire hand or at least through the first or second additional dealt cards. Because players stay in each hand longer, larger player pots are built, and players find the potential rewards of playing and winning to be a significant enticement to play the game, as compared to prior art casino poker games.

In the description of the invention herein, the term "game" will be used in two senses. In the broad discussion "game" will mean the overall inventive concept of the described variation of poker in which players can obtain two winnings on a single hand of cards. In this sense, players may participate in the "game" over a period of time (e.g., several hours) repeatedly dealing, betting and playing an extended sequence of dealt hands. Thus players would, say, spend an evening "playing the game." Alternatively, in the description of play herein "game" will mean a single round of deals and bets to determine the outcomes of a single hand for each player against the dealer's hand and the other players' hands. In this sense, each round of dealing of a five-card hand to the dealer and each player, with the resultant payout of winnings against the dealer and distribution of the pool pot, constitutes a "game" and the players and dealer thereafter start another "game" with another dealt hand to the dealer and each player. This second usage is to avoid possible confusion with the use of the term "hand" when the latter refers to the cards dealt to each player and the dealer. The distinction is that each player and the dealer receives, evaluates and plays their own individual "hands" within a single "game" and then, following the completion of the "game" using those "hands," they proceed to a next "game" with a new round of "hands." The context will make evident the intended meaning of each of the terms where they appear.

BRIEF DESCRIPTION OF THE DRAWINGS

FIG. 14A shows the initiation of the hand and dealing of the initial two cards, while FIG. 14B shows the dealing of the remainder of the cards and completion of the hand.

DETAILED DESCRIPTION OF THE PREFERRED EMBODIMENTS

Figure 1:
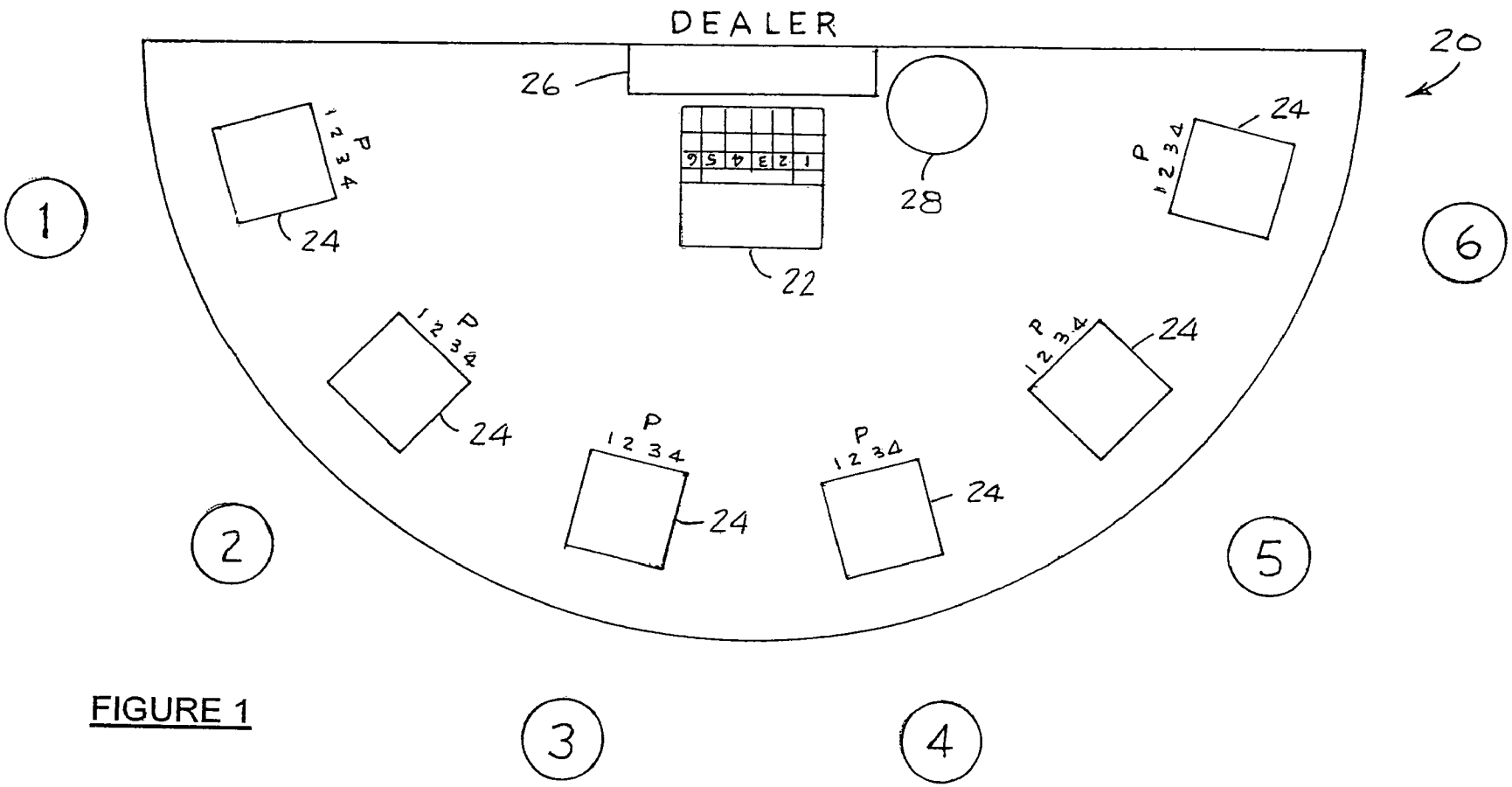
FIG. 1 is a plan view of a casino table configured for playing the poker game of the present invention showing the dealer's positions, positions for up to six players and a typical position for the accumulation of the chips in the players' pool pot.
Figure 15:
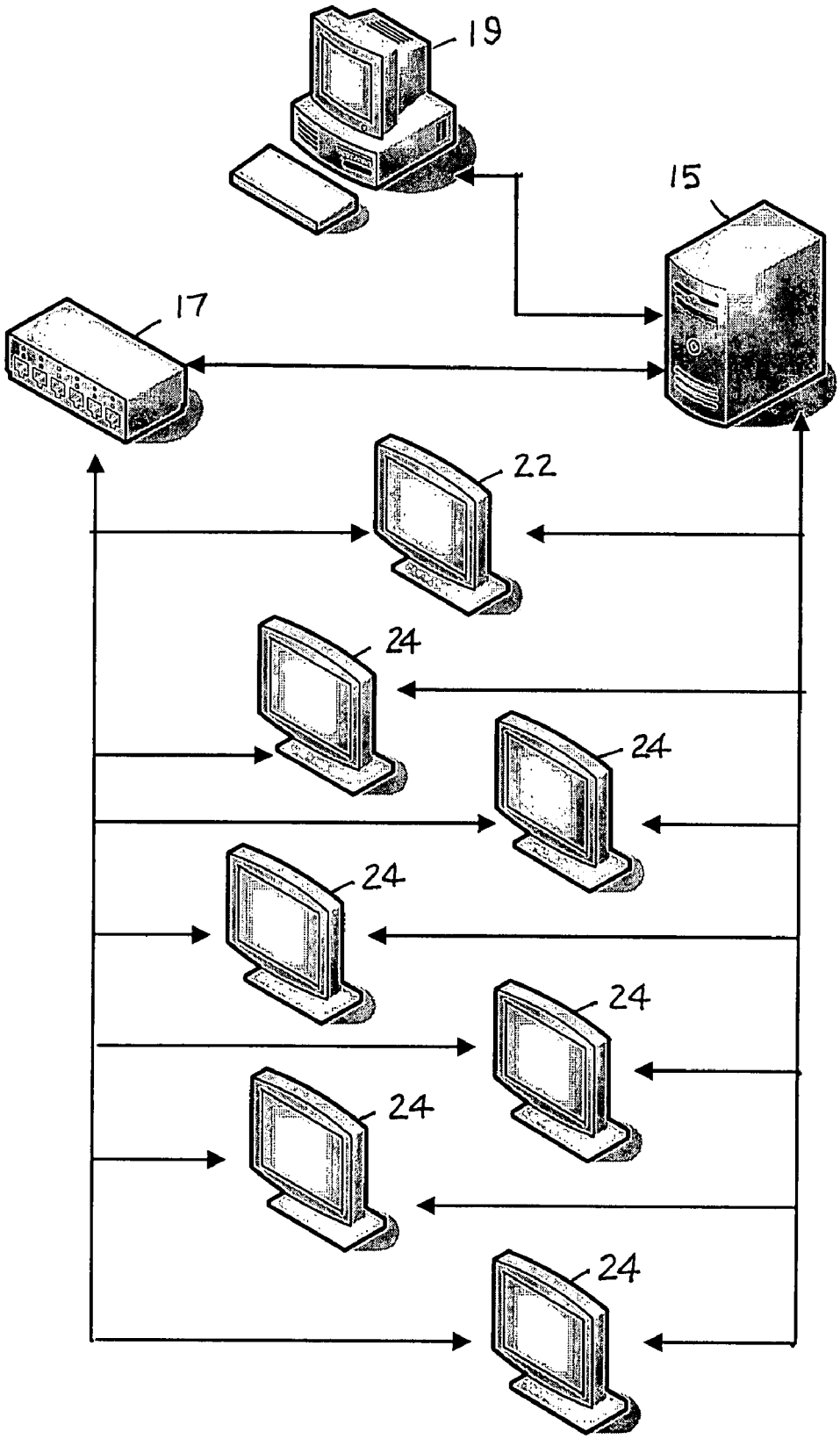
FIG. 15 is a pictorial diagram of the computer hardware used as the electronic part of the apparatus of the game.

The present invention is best understood by reference to the Figures and the subsequent recitation of the play of an example game. FIGS. 1 and 15 show the apparatus used for playing of the game. FIG. 1 illustrates the typical arrangement of a casino table 20 configured for the present game with up to six players and a dealer. The players' positions are indicated by the circles numbered 1-6 along the curved perimeter of the table 20, proceeding counter-clockwise starting on the dealer's right. There may be fewer or more player positions, up to eight (the maximum allowable for single-deck poker), depending on the configuration of the table and space available on the casino floor; five or six positions would be the normal number of table positions in most casinos. Playing of the game is not dependent upon players occupying all of the available positions. Conveniently the conventional half-circle casino card game table 20 is used, although other table configurations are suitable depending on the number of players and the ability of each player to see the other players' and dealer's monitor screens showing their hands. Adjacent to the dealer's position is a conventional poker chip rack 26 and a marked area 28 for collection of chips bet into pool pot.

Figure 3:
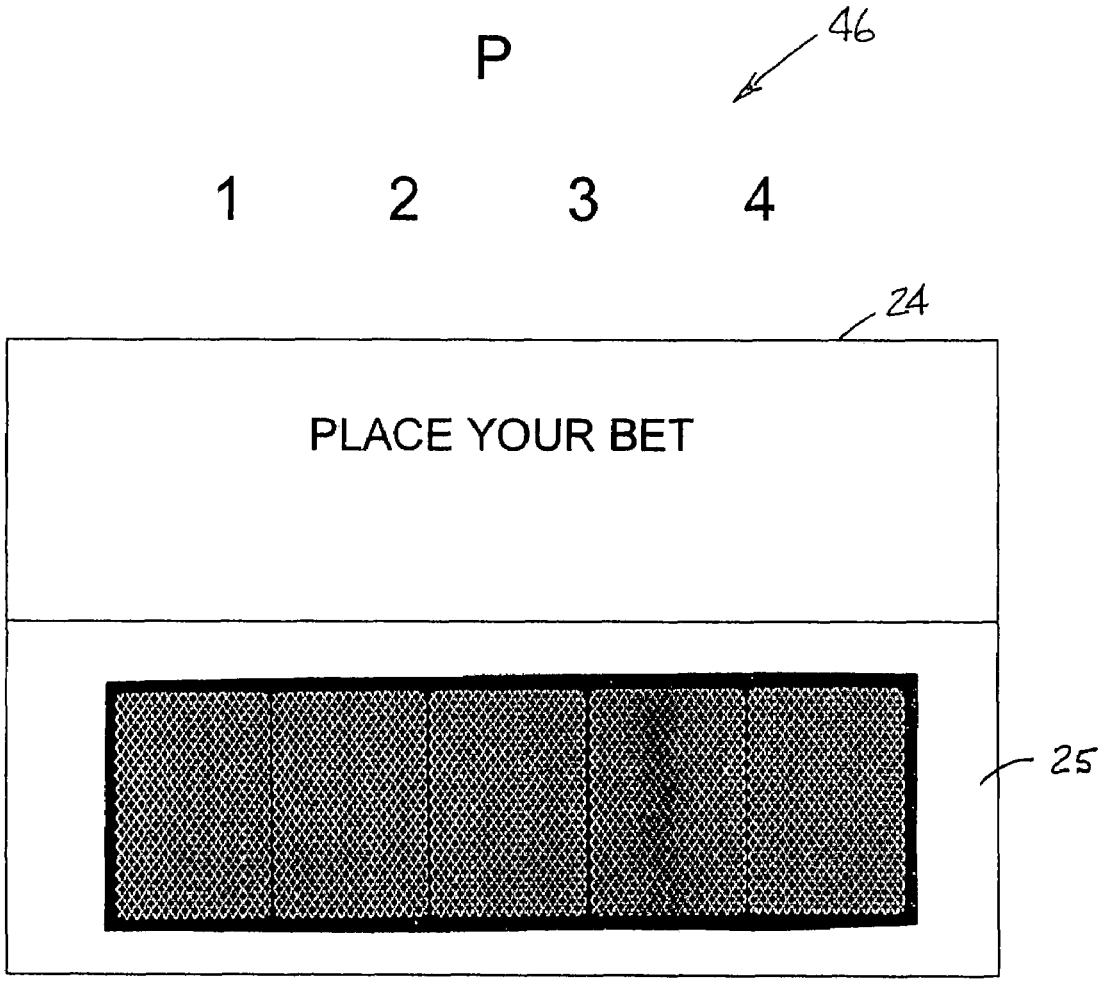
FIG. 3 is a diagram of a player's table position prior to start of a game, showing both the player's monitor screen and the markers indicating locations for placement of bets by the player.

In front of the dealer's position and each of the players' positions is a computer monitor screen 22 or 24 built into the tabletop. All the players' screens 24 have the same configuration, which includes a card viewing portion 25 in which images of the player's cards appear. It is preferred that at all times during a hand five card images remain on each player's screen in portion 25 so that each player can easily follow the play of the game. At the start of a hand all cards will be face down, so the screen image will show only the backs of all five cards, as indicated in FIG. 3. As each hand progresses, successive cards will be "dealt" face up, so the images of the "dealt" cards will change to images of the faces of those cards, as indicated in, e.g., FIGS. 6, 7, 10 and 11, until the game is completed and all the values of all "dealt" cards are revealed. An equivalent display of the dealer's cards appears in portion 30 of the dealer's monitor screen 22.

Figure 2:
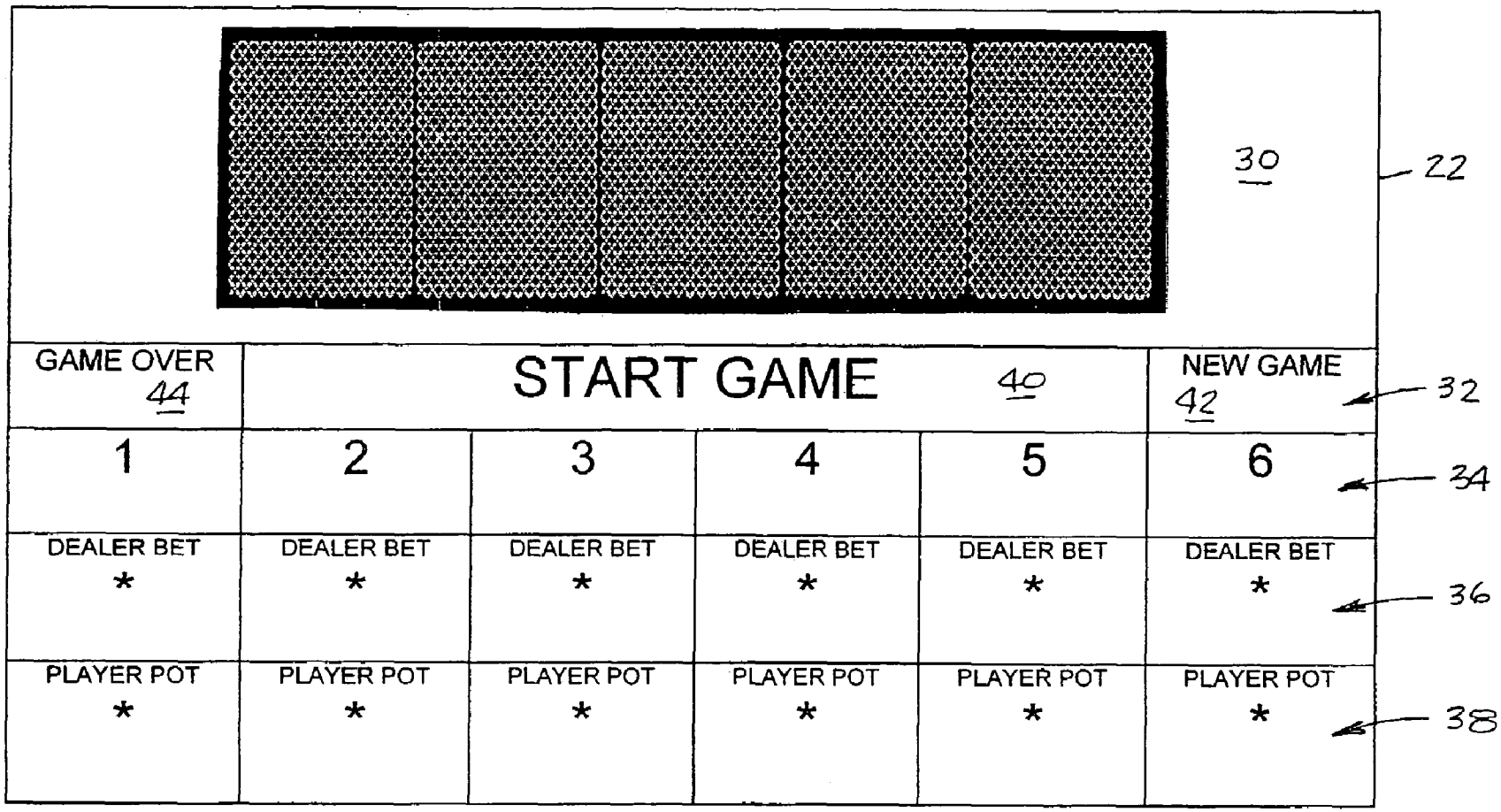
FIG. 2 is a diagram of the dealer's monitor screen prior to start of a game.
Figure 4:
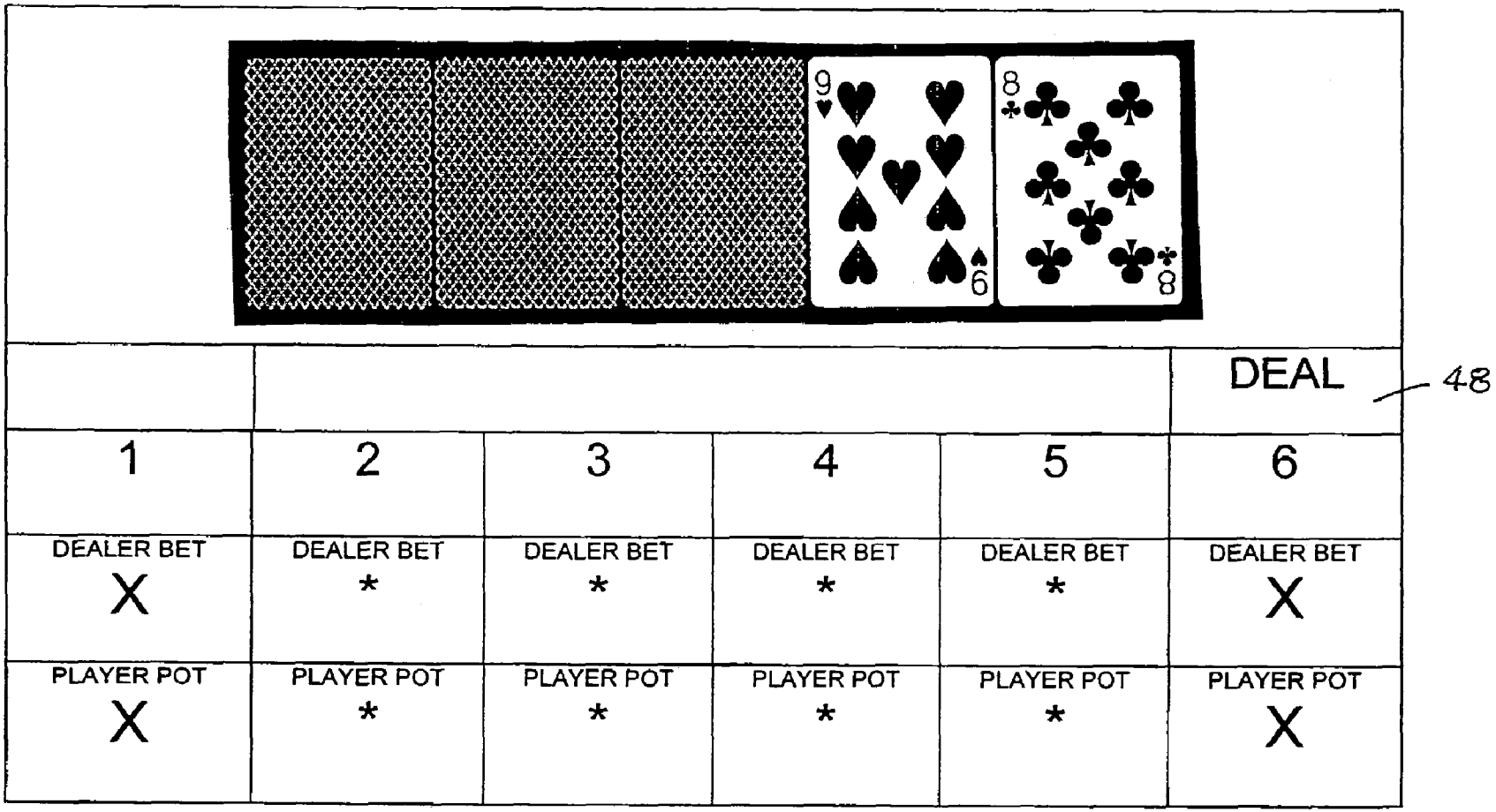
FIG. 4 is a diagram of the dealer's monitor screen after the antes have been placed and the initial two cards dealt. The Xs in columns 1 and 6 indicate that there are no players at those positions for this game.

In other regards, however, the dealers screen 22 is significantly different from the players' screens. The dealers screen 22, which is shown in FIG. 2 in its configuration prior to initial dealing of the hands, is a touch control screen which allows the dealer to operate the computer software which controls the play and flow of the game. The upper portion 30 of the dealer's screen, which is closest to the players, shows the cards being played in the dealer's hand. Three of the four lower rows 32, 34, 36, 38 (the control rows) of the dealer's screen 22 are variable: and allow the dealer to run the game. In the initial configuration the upper part 30 of the dealer's screen 22, where the cards in play will be shown during the hand, will either be blank or, as illustrated, show the backs of up to five cards. (Alternatively a casino may elect to have some other indicia shown in portion 30 between games, such as the casino logo or promotional material, but such is not recommended because of the likely effect of being distracting to the players as they prepare for the subsequent game.) The first control row 32 below the card display portion 30 shows the control button 40 for starting a new game as well as the lighted indicators 42 and 44 which show, respectively, whether a new game is in progress or the previous game has ended. The second (34), third (36) and fourth (38) control rows on the dealer's screen 22 are divided into the same number of columns as there are positions at the table 20 for potential players (illustrated in this example as six columns and players), with each player's column designated in the second control row 34 by the player's seating position number 1-6. This row 34 of control buttons does not change its appearance; the buttons are normally used to close out a player's position column if no player is seated at that position or a seated, player folds during a hand. Below the position number row 34 in each of the columns there is a touch control button in third row 36 for the dealer to signal to the software as to whether or not the respective player wishes to bet on the next card in the player's individual game against the dealer, and another control button in fourth row 38 for the dealer to signal to the software as to whether or not the player wishes to bet on the next card against the other players in the players pot. If there is no player at a particular position the dealer's control buttons for that player's position in the third and fourth rows 36 and 38 show the letter X (or some other "non-playing" indicia such as the casino logo) as illustrated in FIG. 4. In FIG. 2 for convenience in describing the invention there is shown an asterisk for each of the player position control buttons in rows 36 and 38 at the start of the game, but in actual practice there would probably be some decorative indicia shown such as the casino's logo in place of the asterisk.

The overall configuration and interconnection of the electronic devices used in the apparatus are illustrated in FIG. 15. The central processing unit (CPU) 15 is loaded with the necessary software (which is described in FIGS. 14A/B) for conduct of the game and operation of the display of all of the monitors 22 and 24. Routing of the signals to the various monitors 22 and 24 as directed by the software is accomplished through router 17. CPU 15 and router 17 are interconnected with each other, and each is also interconnected with each of the monitors. The monitors, however, need not be interconnected with each other. Each player, and the dealer can thus communicate with the software from his/her respective monitor 22 or 24. Preferably the software does not allow for direct communication among the players' monitors 24. The software may allow each player's monitor 24 may to communicate directly with the dealer's monitor 22 but preferably all communication from any player's monitor 24 to the dealer's monitor 22 will be routed through the router 17, which will also permit the communication (such as a "fold" signal from a player via his/her monitor touch screen) to appear on both the dealer's monitor 22 and also on the monitors' 22 of the other players. A general purpose computer 19 may also be present to provide means of configuration of the game software running on the CPU 15. It is not necessary that the computer 19 be permanently interconnected with the CPU 15; rather conventional connection means such as a USB connection may be provided so that the computer 19 can be temporarily connected to CPU 15 as needed but disconnected and used for other purposes at other times. It is contemplated that the electronic apparatus and the table 20 can be used for playing of other electronic games, including card games, by running of appropriate software on CPU 15. For the purpose of the present invention, however, the description herein will be based on having the CPU 15 running the software defined in connection with FIGS. 14A/B.

In the exemplary play of a game described herein, a game with four players present, seated at positions 2-5, is illustrated. Each player's screen 24 prior to dealing of a hand is normally blank or merely shows the backs of up to five cards, as illustrated in FIG. 3. On the table surface above the each of the players' screens in the area indicated as 46 are marked the letter P and below that a row of the numerals 1-4. The letter P is the marked location for each player to place his or her chips' to bet in the player pool and the numbers 1-4 are the marked locations for placing of the ante and the following bets on the successive individual cards dealt in each player's individual game against the dealer.

Figure 5:
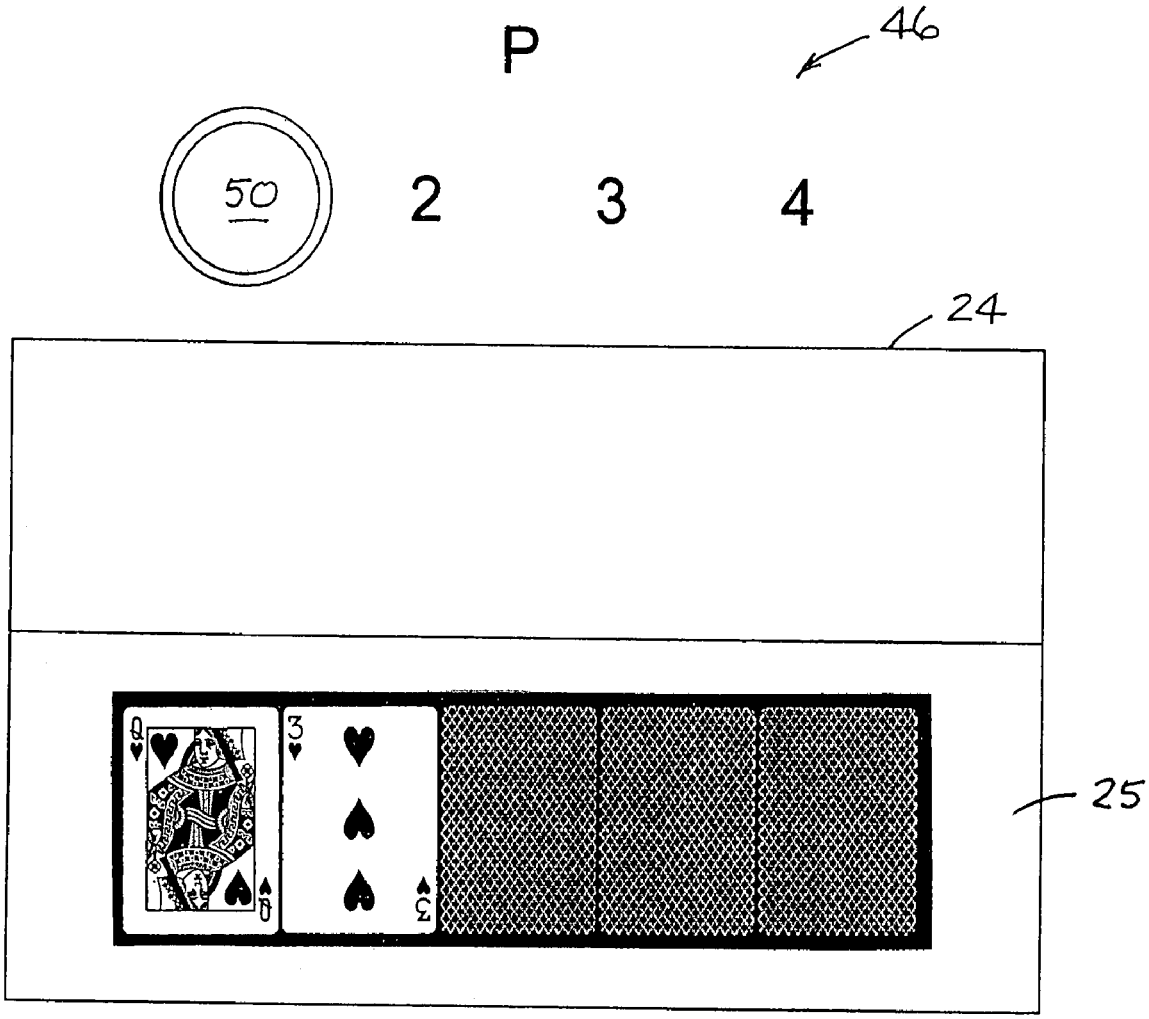
FIG. 5 is a diagram of a typical example of one player's monitor screen and table position (using the example of Player 2) after the antes have been made and the initial two cards dealt. The players ante chip(s) cover the first bet marker.

The game is started by each of the players anteing by placing one or more chips 50 on the 1 marker in front of each player position, as illustrated in FIG. 5. If a player also wishes to play in the player pot aspect of the game he or she also places one or more chips (not shown) on the letter P marker. The dealer inputs to the software through the dealer's screen 22 whether each player is playing against the dealer/house only or also against the other players for the players' pool pot. The amount of betting and/or raising during the play of a hand may or may not be limited according to the house or table rules for the particular game being played. As will be discussed below, various alternatives are contemplated. In one preferred embodiment, either the ante or the first bet by the first player fixes at that amount the bets that all other players must call, if they do not wish to fold. In this embodiment that first bet also fixes at that amount the bets allowable in the subsequent rounds of that game. Raising is not allowed. In other alternatives subsequent players in a round may raise, and that raise maybe limited to a predetermined amount; and/or the bet on each subsequent round may be reset by the bet on the ranking player in that round; and/or checking by the ranking and subsequent players in a round may be allowed, with a subsequent player in the round starting the betting. It will be evident that any level of betting, calling and/or raising may be specified by rules for a game, series of games or an entire period of play.

Once all players have anteed the dealer moves the pot chips from the P markers in front of the players to the "Pot" area 28 of the table close to the dealer and then presses the "start game" button 40 on the dealer's control screen so that the apparatus "deals" the first two cards electronically to the dealer and each player face up. The deal may be a regular poker deal or it may be a biased deal as will also be discussed below. At the end of this first deal the dealers screen changes to the configuration shown in FIG. 4 to show the dealers initial cards and each players screen shows the initial cards dealt to the player as indicated in FIG. 5. Each player can now see the status of the other players' hands as well as the dealer's hand as diagramed in FIG. 6 (in which the players' positions are shown as in FIG. 1, with Player 2 at the dealers right and the other Players 3, 4 and 5 in sequence counter-clockwise, ending with Player 5 on the dealers left). Note that the dealers cards are oriented so as to face the players (reading the cards conventionally from left to right) while the players' screens also have the same orientation, so that all card hands are facing the players.

Customarily as in other poker games the player with the highest ranking hand shown (in the example this is Player 3 with cards A-K) starts the betting for the deal of the next card, by placing the appropriate chips on the 2 position marker. Each of the other players in sequence around the table then decides whether to call the bet, raise the bet or fold his/her hand, depending on the rules of the game. The dealer neither bets nor folds throughout the hand. In the example game each of the player is shown as continuing with a bet (but no raise) in order to obtain a third card in this round. If a player betting also bets into the pot by placing additional chip(s) on the letter P in front of him/her all other players must also bet into the pot if they wish to continue in the player pool pot. A player may at any time stop placing any further chips into the pool pot but if he/she does so his/her chips already played into the pot in this game are forfeited and he/she is not permitted to reenter the pool pot on subsequent card rounds in this game. However, the player continues to play against the dealer unless he/she subsequently folds.

Figure 7:
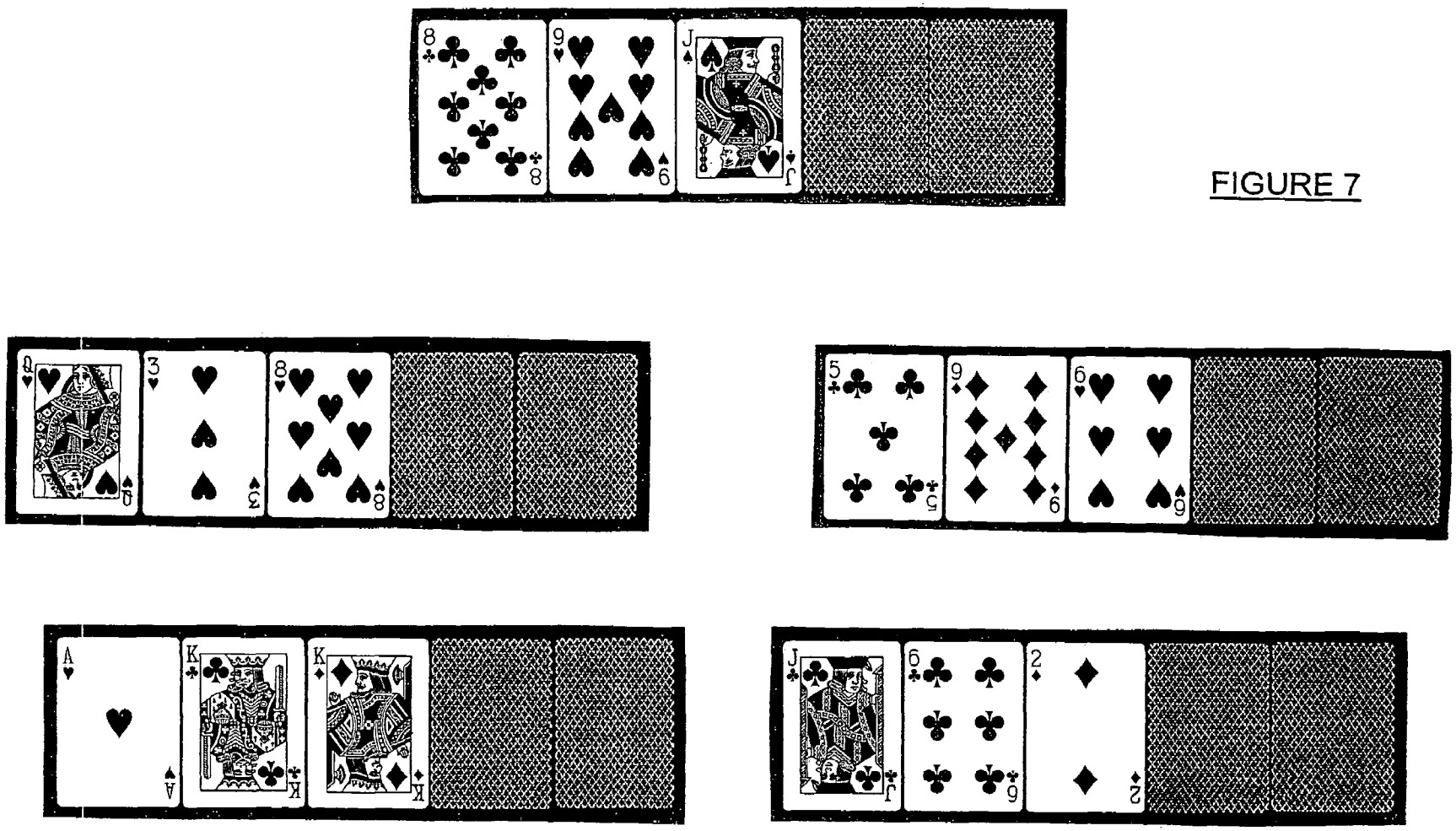
Figure 8:
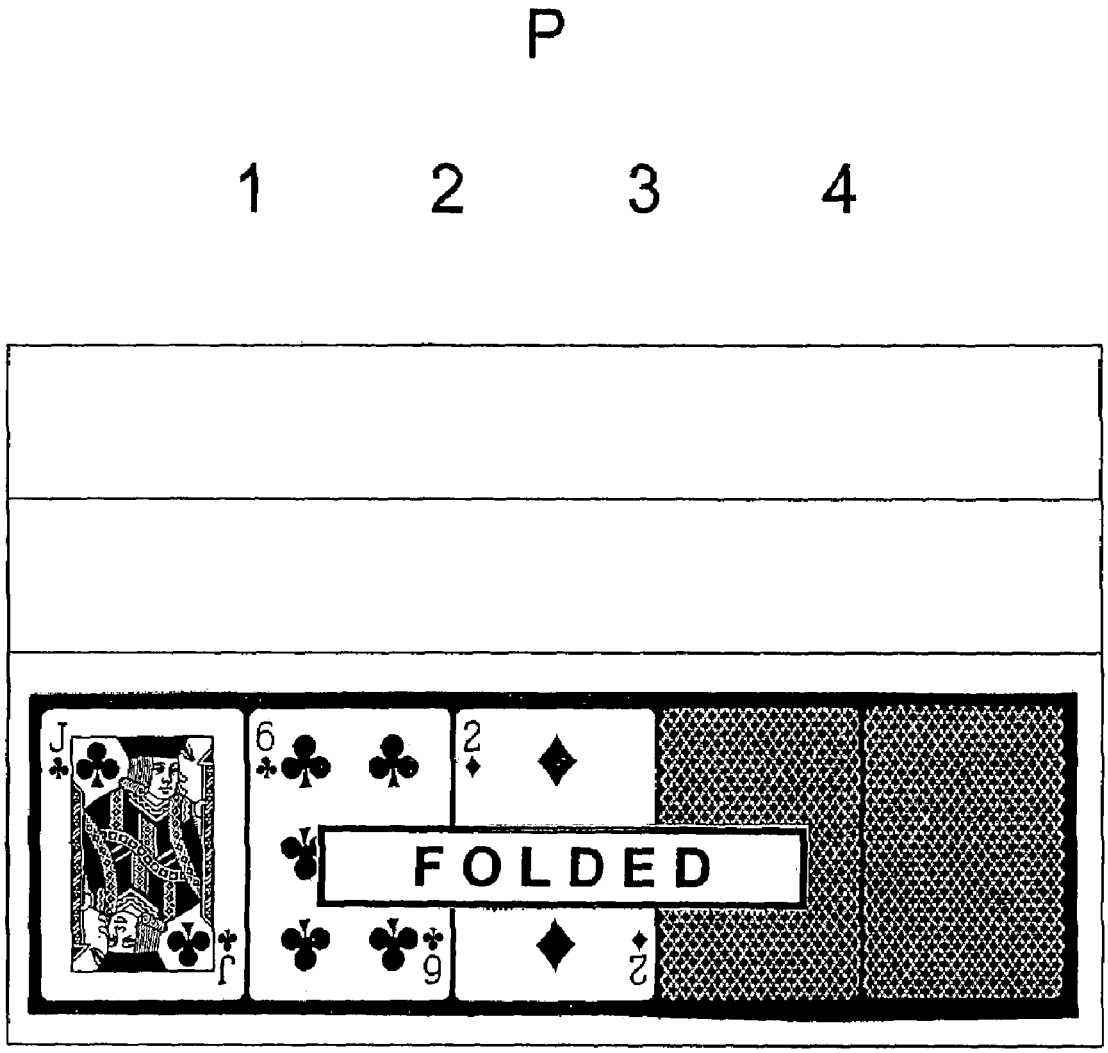
FIGS. 8 and 9 are diagrams, respectively, of the monitor screen of a player (here exemplified by Player 4) and the dealer's monitor screen following that player's folding during the example game.
Figure 9:
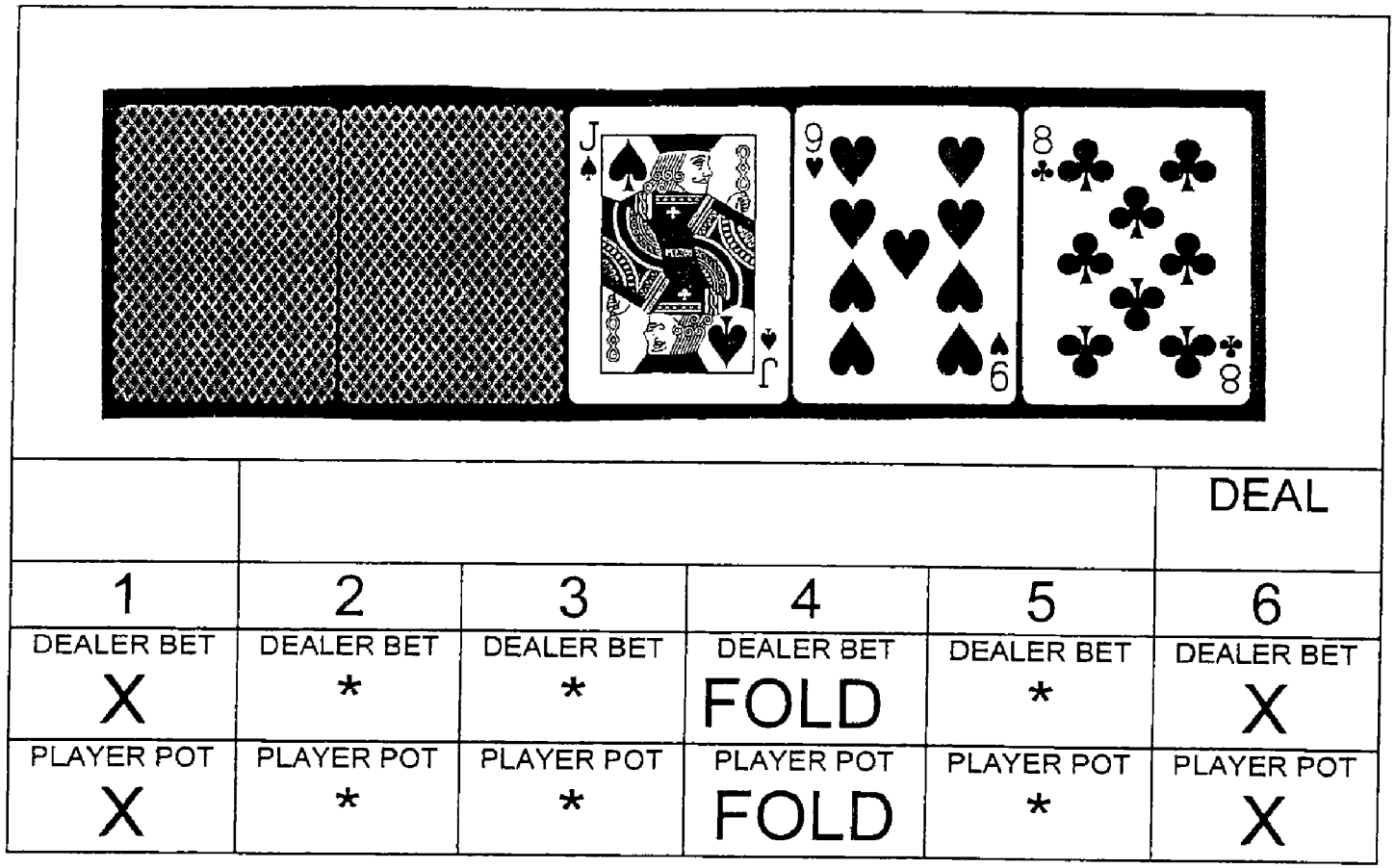

When all bets are placed the dealer again collects the pot chips placed on the P markers, moves them into the "pot" 28 and then presses the "deal" button 48 on his control screen 22 and the apparatus deals a third card to the dealer and each of the continuing players. The configuration of the screens after this second deal is shown in FIG. 7. Once again the then-highest ranking player (in the example this is still player 3 now with A-K-K) starts the next round of betting by checking or placing a bet on the 3 marker on the table in front of him/her. Each player in sequence again decides whether to bet, call, raise or fold in the conventional poker manner. At this stage in the example Player 4 decides to fold his/her hand. The dealer will then collect that folded player's chips on the player's 1 and 2 markers and the player's chips placed in the player pot by the player will be forfeited to the pot. The dealer also then presses the bet and pot buttons in column 4 of the dealer's screen, which causes the word "FOLD" to be displayed on the dealer's screen 22 in column 4 as shown in FIG. 9 and the word "FOLDED" to be displayed across Player 4's cards on his/her screen 24 as shown in FIG. 8, so that the continuing players have a visual indication that Player 4 has folded and is no longer participating in the game.

Figure 10:
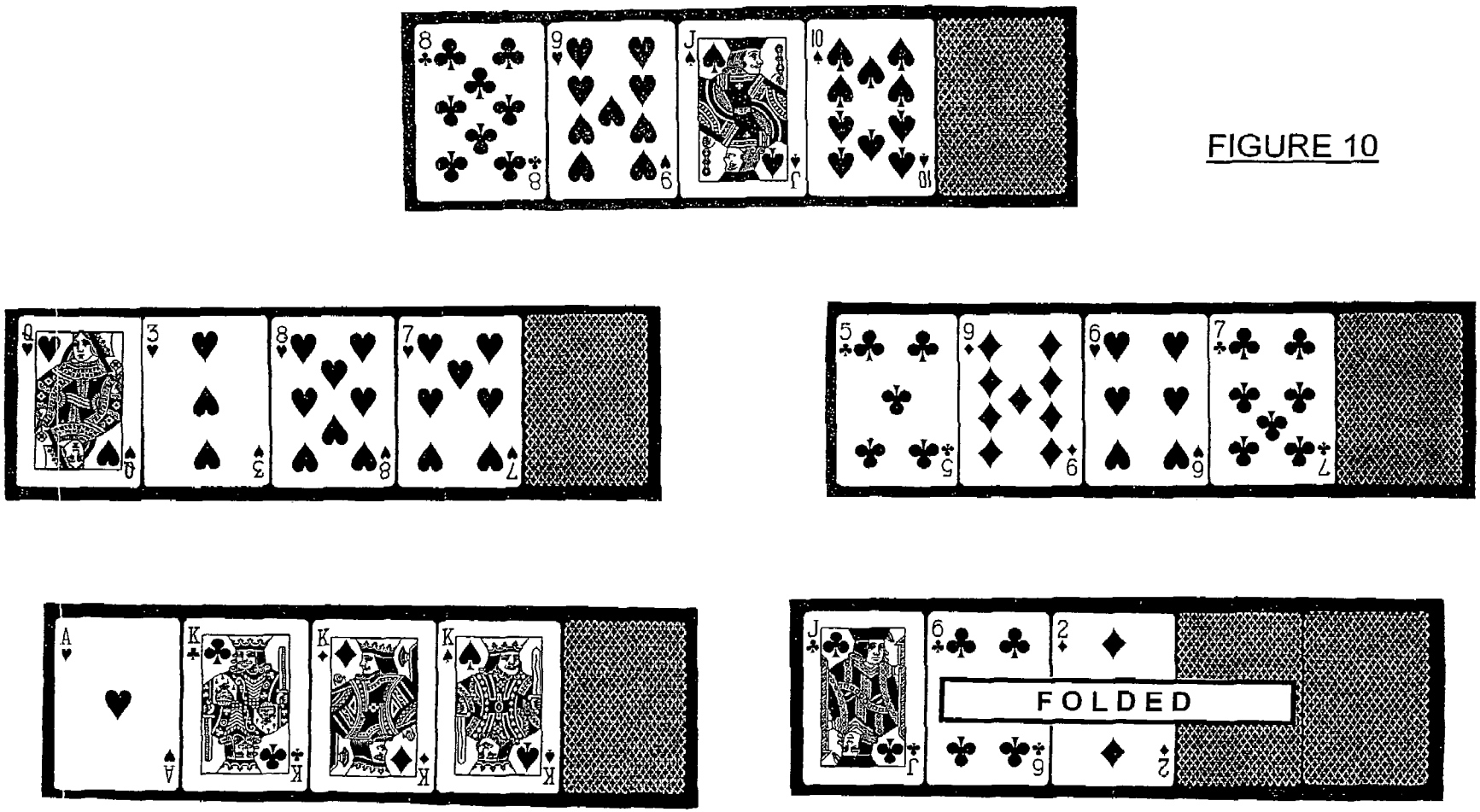
Figure 11:
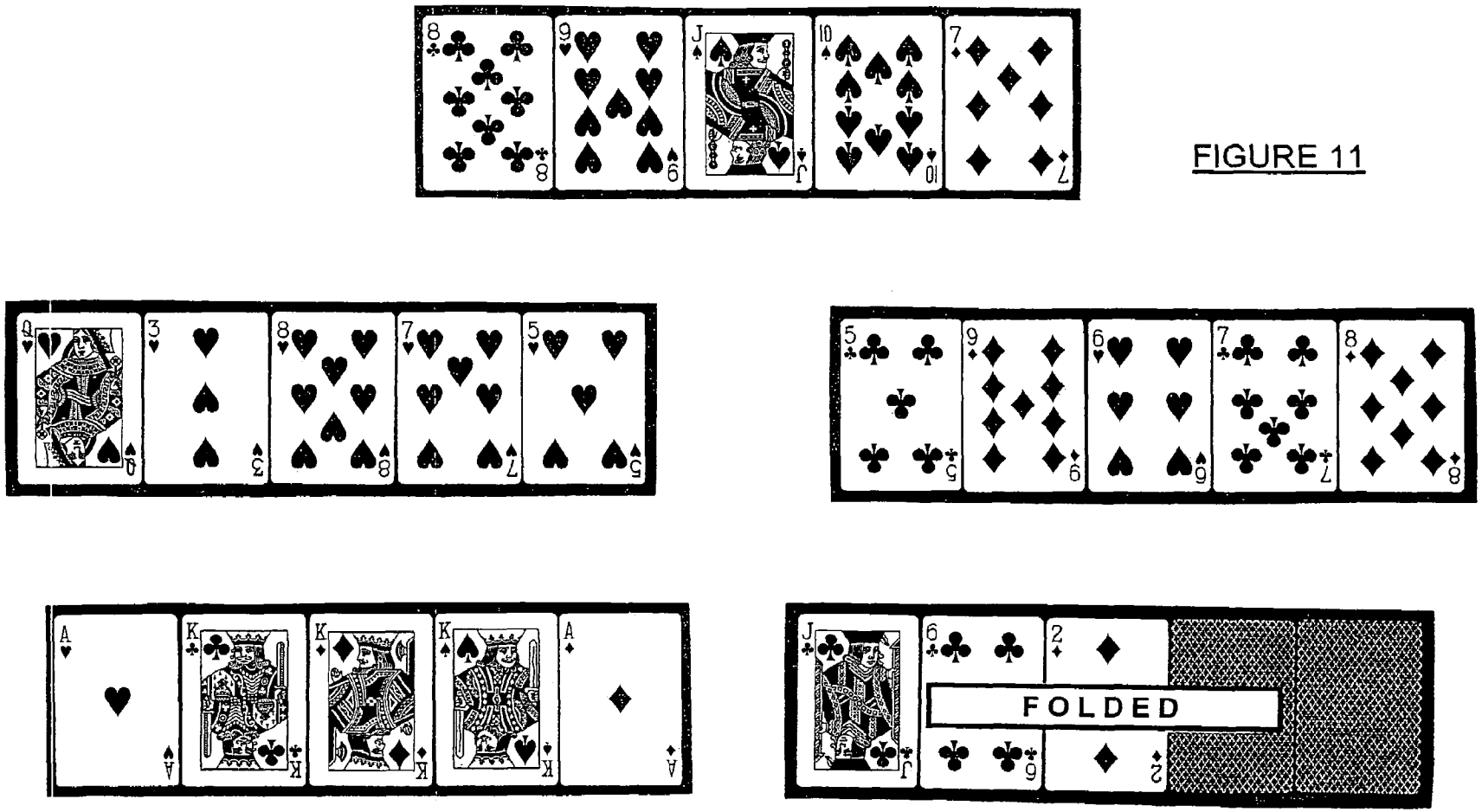
Figure 12:
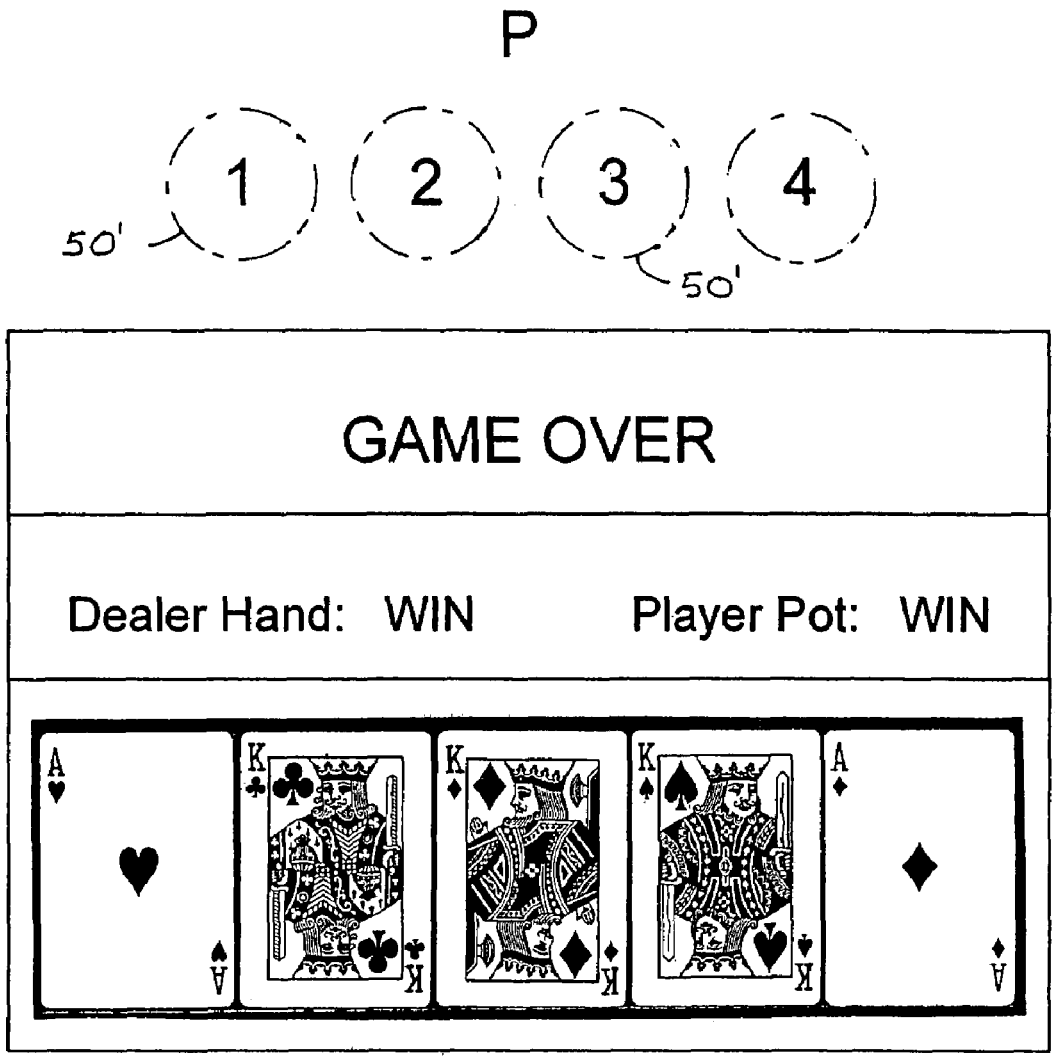
FIG. 12 is a diagram of the monitor screen at the end of the game of a player (in this example Player 3) who has both beaten the dealer and also won the pot against the other players. The monitor screens of the other players who complete the game will be similar with the applicable "WIN" or "LOSE" indicated for each player with respect to the "dealer hand" and the "player pot".

The last two rounds follow in the same manner with the status of the hands being as shown in FIGS. 10 and 11. In the example all the remaining Players 2, 3 and 5 are shown to have elected to continue through the final deal. It will be seen from FIG. 11 that the dealer ended with a straight with J-10 high. Player 5 therefore loses to the dealer since Player 5's hand is a lower ranked straight (9-8 high). As noted above, it is preferred that a player's loss against the dealer will also constitutes the player's loss against the pot. Player 2, on the other hand, has beaten the dealer by having a flush, which outranks the dealer's straight in the conventional poker hand hierarchy. The dealer therefore pays Player 2 a number of chips equal to the number of chips which Player 2 has bet on his/her 1-4 markers (a 2-1 payoff). Player 2, however, loses to Player 3 for the chips in the pot, since Player 3 has obtained a full house (Ks over As) which ranks higher than the hands of the dealer and of Players 2 and 5. Player 3 therefore receives the 2-1 payoff for his/her 1-4 bets from the dealer and also collects the entire pot from the other players; i.e., he receives all of the chips accumulated in the "pot" area 28. Player 3's final screen 24 is shown in FIG. 12 indicating both his final hand and his wins against the dealer and the other players in the pool pot. The final screens 24 for Players 2 and 5 are not shown, but similarly show the player's final hand and "win/lose" status against the dealer and in the pool pot. (The chips placed on the 1-4 markers sequentially during play of the game are not shown directly in the Figures. It will be understood, however, that for each player who completes a game, at the end of the game there will be chips 50' on each of the 1-4 markers, as indicated in phantom in FIG. 12, which will be equal to the player's bet against the house/dealer. A player who has beaten the dealer will receive the payoff described above based on the chips bet on the 1-4 markers, while the chips on the 1-4 markers of players who have lost to the dealer will be collected by the dealer.

Normally there will be a definite "high hand" among the players so that, preferable assuming that the high hand has beaten the dealer's hand, the player with the high hand will be the sole winner of the players' pot. In the rare instance where two players have equally high hands (for instance, two equal straights or flushes), the pot can be split between them. It is also contemplated that house or table rules can provide for split pots in other situations or even in every game in which two or more players complete the game (and, preferably, also beat the dealer). Pots may be split into equal shares to each player who beats the dealer, or they may be split into graduated-size shares according to the relative rankings, of the winning hands. In this regard, house or table rules may permit all players who complete the game (i.e., have not folded during the game) and who have also bet into the pot at each round of the hand, to participate in a split of the pot, even if they have not also beaten the dealer. The latter variation is not preferred, however, and should be considered only if the shares are graduated and the shares returned to players who did not beat the dealer are less than the amounts they bet into the pool pot, to discourage players with weak hands from continuing to play in a game in effect just to get some portion of their bet back.

Figure 13:
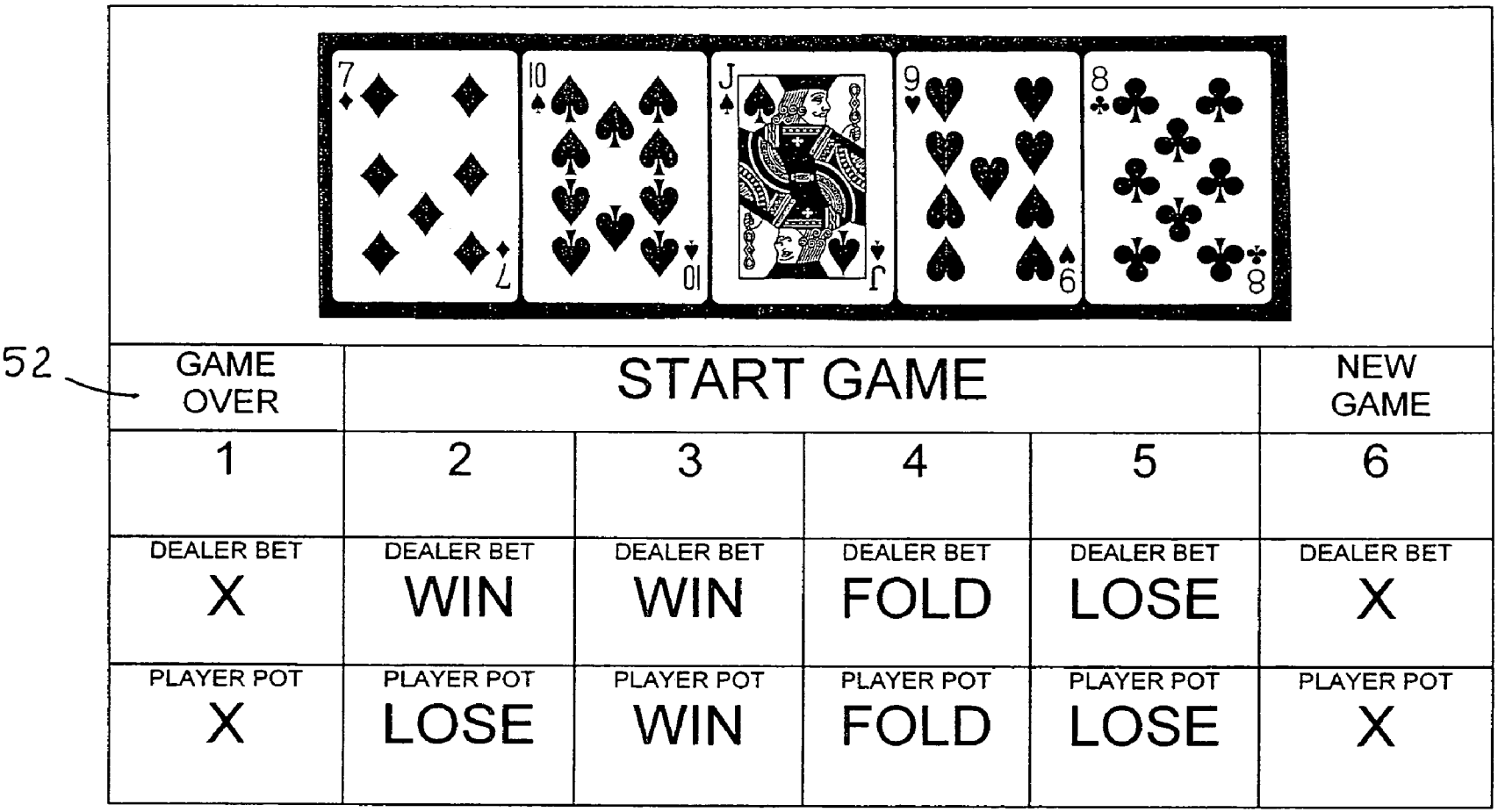
FIG. 13 is a diagram of the dealer's monitor screen following the end of the exemplary game, showing the dealer's final hand and the "WIN", "LOSE" or "FOLD" status of each player upon conclusion of the game.

The hand now being over, the dealer's screen for a period of time shows the configuration illustrated in FIG. 13, with the dealer's final hand and the final hand status of all of the participating players. The final configurations of all dealer and player screens 22 and 24 are normally maintained until payment of all bets from the current game has been completed and dealing of the next hand is initiated. If there are no issues of play raised by any participant of the game, after the predetermined time the dealer's screen 22 reverts to the configuration shown in FIG. 2 and the players' screens 24 return to the FIG. 3 configuration in preparation for the next game. It is contemplated that the software can include a function to allow the dealer to extend the "hold" of the FIGS. 12 and 13 configurations following a game in the event that any participant in the game raises any issue regarding play of the game, so that all participants, can continue to refer to the results of the game while the issue is considered, whether by the participants, the dealer and/or representatives of the casino or appropriate gaming authorities. If desired, that function may include, after each hand, an automatic short time delay before the next deal can begin, to permit the dealer and the players time to review the play of the game and identify any suspected or actual discrepancies and see if a longer "hold" is needed. Such a time delay should normally be no more than about 1-2 minutes, to avoid undue slowing of the overall play. (However, in practice the time needed to pay bets from the just-completed game usually is sufficient time for any discrepancies to be noticed.)

Figure 6:
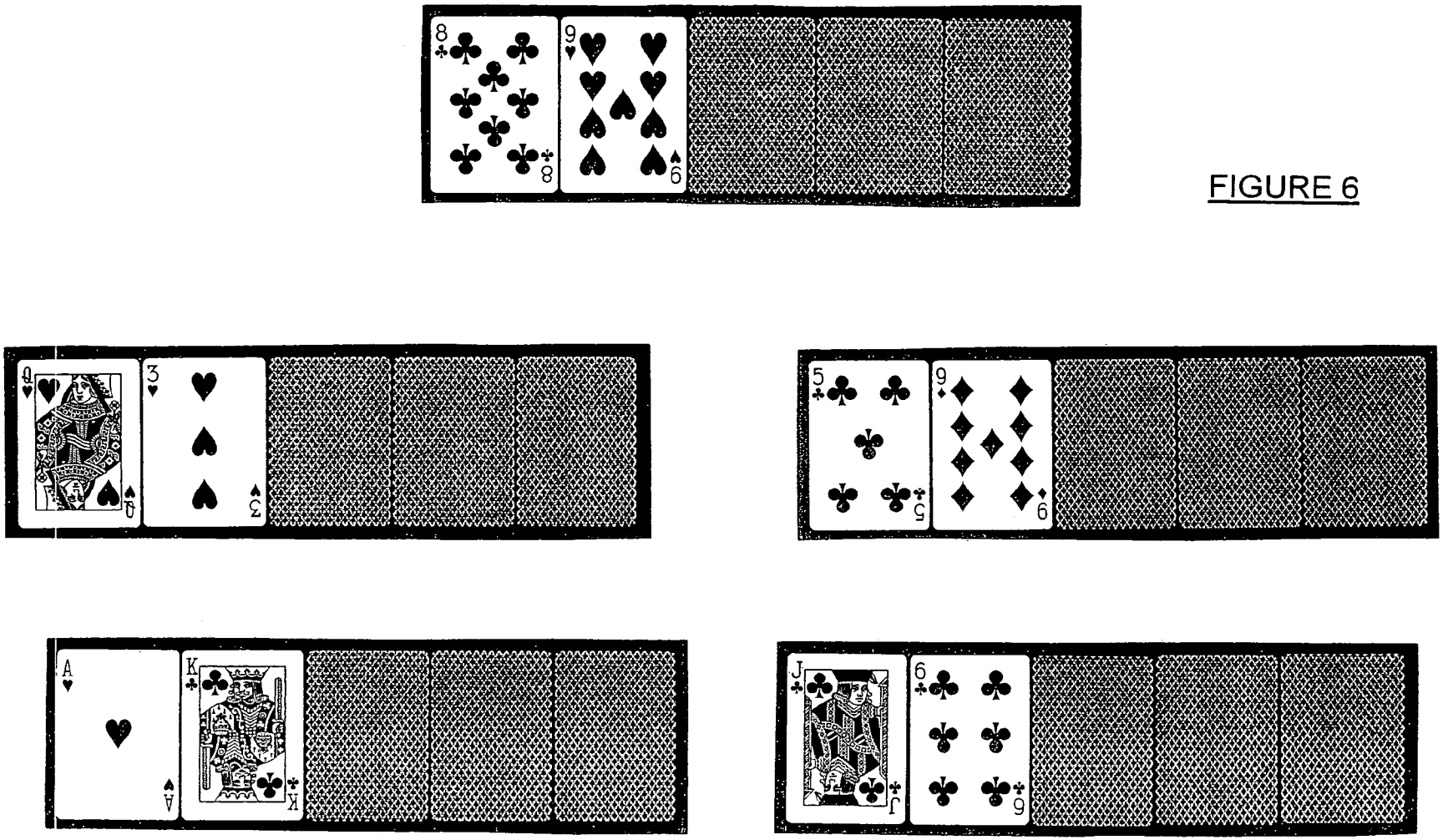
FIGS. 6, 7, 10 and 11 are diagrams showing the cards indicated on all of the players' monitor screens and the dealers monitor screen following, respectively, the ante deal and three subsequent card deals showing the progress of example hands of the game of the present invention.
Figure 14A:
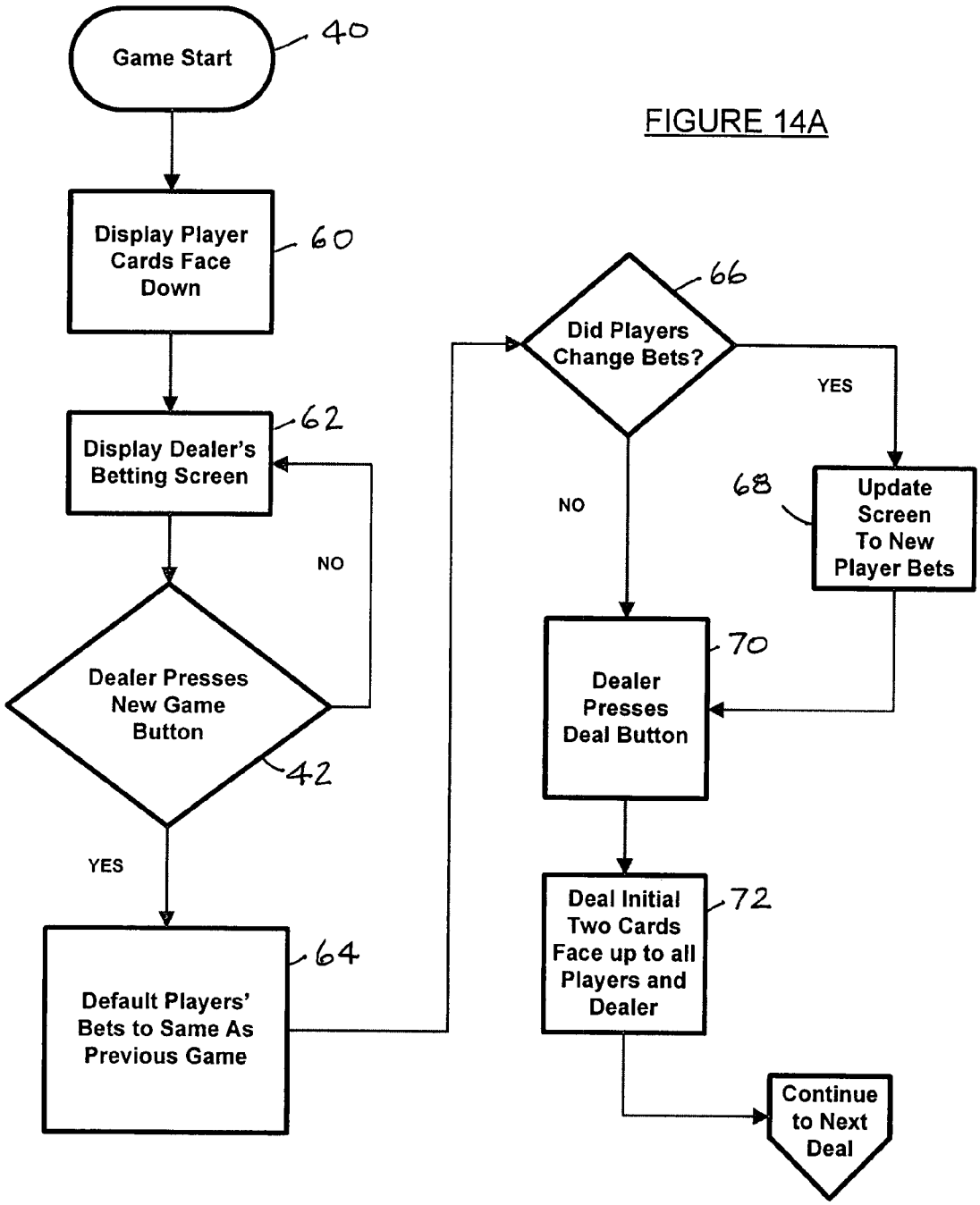
FIGS. 14A and 14B (collectively "FIGS. 14A/B") are a schematic flow diagram of the software logic for playing of a single hand of the game of the invention.
Figure 14B:
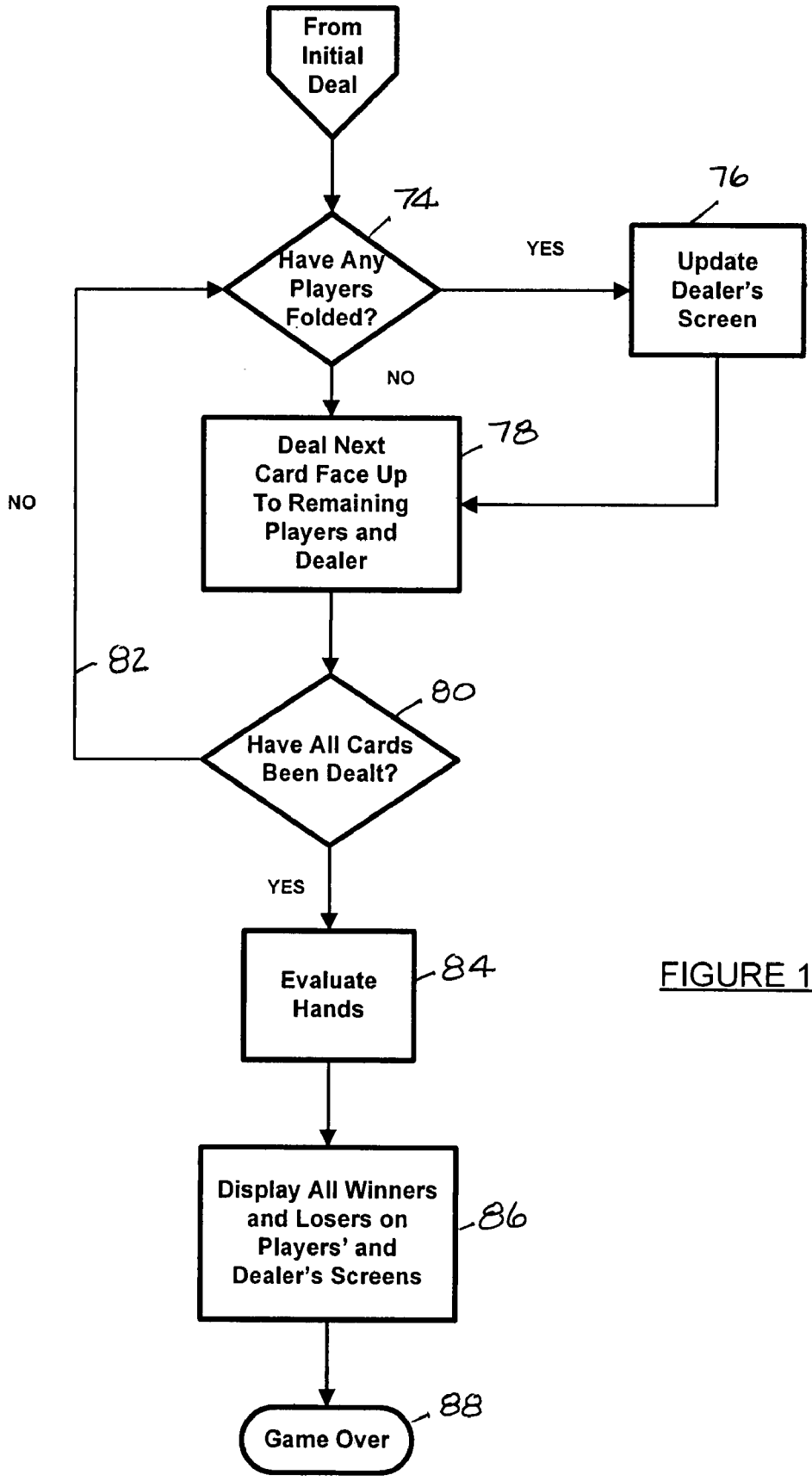

The software which runs the game is illustrated schematically in FIGS. 14A and 14B. Specific coding is not shown, since the functions are clearly defined and those skilled in the art will be readily able to write software which accomplishes these functions. It is contemplated that various software codes may be used for the different functions. Regardless of the specific code, however, it will be recognized that software which performs the defined functions in any sequence which results in the games of this invention will be within the scope of the appended claims. As illustrated in FIG. 14A, the game is first activated by the dealer's touching the START GAME command 40 on his/her monitor 22's touch screen. The software then displays five cards face down on the card area 25 of each player's monitor 24 as described above, as well as in the card area 30 of the dealer's monitor 22, as indicated at 60 and 62. The dealer then presses the NEW GAME command 42 and the software defaults to the players' previous bets at 64. If new players have come to the table, or prior players have left, or any of the continuing players has changed his/her bet, such changes are accommodated by the dealer at 66 and 68, to enter into the system the new information in areas 36 and 38 on his/her monitor 22, as needed for proper playing of the new hand. Once the system is in order, the dealer presses the DEAL command 48 and the first two cards are dealt, as indicated at 70 and 72. The respective card images then change to showing the card faces, as illustrated in FIGS. 5 and 6. The hand then proceeds as indicated above as the players evaluate their initial two cards and bet accordingly for the next card. The dealer observes whether any players have folded at 74 and if so, updates the dealer's screen and each folder player's screen accordingly at 76. Thereafter the dealer again activates the DEAL command 48, next card is dealt at 78 and the hand continues with the players again evaluating their hands and the dealer determining if any players have folded. If not all the cards have yet been dealt, the software process cycles as indicated at 80 and 82. This loop continues until the final cards have been dealt to whichever players remain in the hand at the end. Once the final card has been dealt, the remaining hands are evaluated by the software at 84 and the winning and losing hands identified at 86 and shown in total on the dealer's screen as in FIG. 13 and for each remaining player, on his or her screen as in FIG. 12. After a suitable review period as described above the dealer activates the GAME OVER command 52 and ends the hand at 88. The software then resets itself pending the next hand. Alternatively the GAME OVER command can be activated automatically by the software at the end of the review period, unless the dealer has activated a REVIEW command (button not shown) as discussed above to permit further review of the game. It is contemplated that the software may include a function to present the words "GAME UNDER REVIEW" or equivalent indicia on all monitors in such instance.

It is also contemplated that preferably a "qualifying hand" will be established by house or table rules in order for a player to win against the dealer/house. For instance, the qualifying hand could be defined as a pair of sevens. If the dealer's hand upon completion of a game does not rank above a pair of sevens, all players that have not folding during the course of the game will win only a single bet against the dealer, rather than winning all four bets (on the 1-4 markers) against the dealer. Alternatively, the win against a non-qualifying dealer's hand for a player completing the game could be defined by rules as return of the player's ante bet placed on the 1 marker, with no winnings from any of the 2-4 marker bets. In either case all of the non-folded players wins the single- or ante-bet from the dealer, regardless of whether a player's hand does or does not beat the dealer's hand. Also, the ante and all 2-4 marker bets made by the non-folding players are retained by them.

The software system may also incorporate various functions common to other electronic games and game tables. For instance, for times when there may be no players at the table, the normal dealing and card displays on the monitors may be replaced by screen savers, displays of casino logos, game demos or teasers, or other displays of visual images and/or indicia. Such displays will usually be designed to attract players to the game and table. The system preferably will also have the capability of full recording all hands and the play of those hands during each game, and retaining such records for all or a series of games (usually at least a moving ten-game sequence). In practice, such function is intended to be present as a standard feature with complete recording, since it is commonly required by the governing gaming authorities that all games must be fully recorded and the records retained indefinitely of for a prescribed period for audit purposes, investigation or surveillance if cheating may be suspected, and similar regulatory purposes.

While it is mentioned above that the players' monitors 24 are for the purpose of the present game dedicated in their touch screen functions primarily to allow the player to communicate folds or similar game-related information to the dealer, it is contemplated that such dedication limits will be part of the software, so that if desired other functions may be present in the software that override or supplement those dedication functions. Such changes would be under control of the casino and not the players. For instance, the software may include functions that allow the touch screens of the monitors to be used for the playing of other games, the selection of various video or other visual images or indicia to be displayed on the monitors, or as general purpose monitors.

Each game can be played with a regular deal, as in a conventional poker game, so that the cards as dealt can be any five-card combination within a deck of cards from the lowest possible ranking hand (2-3-4-5-7, assuming A is high only) to the highest possible ranking hand (an A-high straight flush). However, it is preferred that biased dealing be used to enhance the game experience for the players. The purpose of a biased deal in the present game is to increase the likelihood that each of the players will be dealt a reasonably good poker hand. This reduces the chance that players will get poor early cards and fold at an early round, leaving only one or two continuing players and substantially reducing the amount of the player pot available. Numerous types of biased deal methods are known and most are likely to be suitable for use in the present game. The specific type of biased deal is not critical. However, a particularly preferred biased deal method for use in the present game is one in which the biasing comprises first selecting as an initial single hand rank a first random number between 0 and the number of possible hands and then utilizing the initial single hand rank with a deviation multiplier to determine a range of possible hand rankings for each of the players in the card game. Each player will have assigned a hand rank within that range. The effect of the biased deal is therefore to concentrate the values of hands dealt to all players around an initial hand value and decrease the proportion of hands of significantly lower or higher rank than the initial hand value which would otherwise have resulted from non-biased dealing of the hand. The players will not know each others' actual hand ranks, but will know that all of the hands will be within that range, and thus each player can play accordingly.

The process is best illustrated by first considering the number of hands (card combinations) possible in a conventional five-card poker game. There are nine types of hands, which are listed in the Table below in order from lowest value to highest value:

TABLE

Hand Rankings

| Card Combination | Hand Rank Value Range |
|---|---|
| High Card (no pair or higher combination) | 1-8 |
| One Pair | 9-21 |
| Two Pairs | 22-33 |
| Three of a Kind | 34-46 |
| Straight | 47-56 |
| Flush | 57-64 |
| Full House | 65-77 |
| Four of a Kind | 78-90 |
| Straight Flush | 91-100 |

Within each type of hand, the individual hands are further ranked by the face value of the specific cards, from the deuce (2) as the lowest value card and the ace (A) as the highest. Numerous gaps occur in the ordering within the various types, since some combinations nominally within a type may constitute a different type and thus have a higher value since the highest type prevails when evaluating a poker hand for instance, the lowest ranking five-card hand (hand rank=1) in poker is a 7-high, "high card" hand. While a 6-high hand would seem to be lower in value, the 6-high, five card hand actually comprises a 2-3-4-5-6 straight, a higher value combination. On the same basis, the lowest ranked flush is the 7-high flush, since the 6-high flush is the higher ranked 2-3-4-5-6 straight flush. Other such situations will be obvious to those skilled in the art, such as that a hand containing a pair must not also have a third card of the same value, since that would comprise three-of-a-kind, a higher ranked combination than a pair. When the gaps in sequence in the different hand types are taken into account, the result is that the actual number of hand ranks differs among the different hand types. For instance, there are thirteen four-of-a-kind hands (ranked 78-90), but only eight "high card"hands (ranked 1-8). In all cases of the hand rank range in the Table, however, regardless of the number of entries and gaps in each type, the specific rank numbers increase in the 2-A direction. (Note that while the order numbering of 1-100 is preferred as being common and easily understood, any numbering system that maintains the proper playing order of the hands and properly accounts for the increments between their respective value ranks can be used. In such cases corresponding adjustments may be needed in the formula, deviation multipliers and initial hand rank selection, which adjustments will be readily apparently to those skilled in the art.

For each game, a deviation multiplier is randomly assigned to each player. Deviation multiplier values are selected from the range of 0.1-4.0, more preferably 0.5-3.5. While use of only integer values is not required, for ease of computation it is common for the multipliers in an individual game to be limited to the integer values 1, 2 and 3. The higher the multiplier value, the wider will be the range of allowable hands for a player. At least one value must be different from the others, and it is preferred that the values assigned be distributed among the players in approximately equal quantities; e.g., for five players a preferred distribution might be 1,1,2,2,3. The distribution to the individual players of these values is at random, so Player A might be assigned 2, Player B assigned 3, Player C assigned 1, and so forth, and each player is told only his/her own value, and does not know the values assigned to the other players. (Any correspondence between an assigned deviation multiplier value for a player and that player's poker skill level is entirely coincidental; the deviation multiplier values are not skill-based as a golf handicap is.) Also an initial hand rank value is randomly selected, being equal to or less than the total number of possible hands. From the Table above it is seen that the total number of possible poker hands is one hundred, so the initial hand rank value is selected within the range of 1-100. The hand value for each player is then determined by, the formula:

$$\text{Hand value}=\text{Initial Hand Rank Value}\pm(N\times\text{the Player's Deviation Multiplier})$$

where N is a number in the range of about 5.0-15.0, preferably 8.0-12.0. While integer values are not required for N, again for ease of computation in a game it is common for N to be designated as the integer 10. The higher the value of N, the wider the range of allowable hands for a player. In an individual-game, N will be held the same for all players. Application of this formula is straight-forward. For example, assume that the initial hand rank value selected is 50, which corresponds to an 8 -high straight. If N=10, for Player A the hand value range would then be 30-70, which is equal to $50\pm(10\times2)$. That range corresponds to all hands from two pair, J-high (lowest) through full house, 7-high, so in the biased deal for that game, Player A would not be dealt a hand outside that range; i.e., Player A could not be dealt a very low (value=0-29) hand nor a very high (value=71-99) hand. The players are aware that biased dealing is in effect, but they do not know what value has been selected for the initial hand rank value nor do they know what deviation values have been assigned to them. Therefore only as play progresses will each player be able to assess how his/her hand appears to compare to each other player. However, since all players enter the game aware that they have a reasonably good chance to win the game, there is a much enhanced tendency for all players to stay in the game through one or more betting rounds than would be the case in an unbiased deal, where it is much more common for very high and very low hands to be dealt and to become evident quickly, thus suppressing the competition in that unbiased game.

Whether a normal or a biased deal is used, the dollar value of the bets or raises permitted will be determined prior to the game by house or table rules. It is preferred, however, to keep bets and raises (if the latter are allowed) the same or within a narrow range in a hand, in order to encourage most or all of the players to stay in the hand and thus avoid having hands prematurely halted by a sudden overwhelming bet or raise by one player. By thus restricting bets and raises, the game experience is enhanced for all of the players. Thus, in a preferred mode the first player's ante or bet in the first round after the ante establishes the basic bet to the pot and thereafter all players must bet the same amount or raise by not more than a predetermined amount, which is preferably limited to no more than a low multiple of the basic bet. This prevents any player who has an apparently good hand based on early cards to bluff and attempt to "by the pot" by making a large early pot raise and thereby discouraging the other players from continuing. On the other hand, individual players' bets against the dealer may vary or may be determined by the initial player's bet, as predetermined by the house or table rules.

Preferably each player's subsequent bet against the dealer (on the 2, 3 and 4 markers) must be the same as the player first bet at the beginning of the game (on the 1 marker). This is intended to protect the house, in that if a player after one or two card rounds senses that he/she is going to have a better hand than the dealer he/she cannot take advantage of the house by then increasing his/her bet substantially on the remaining rounds.

As mentioned above, the game is primarily intended to be played as an electronic casino game, using a specially configured table with computer monitors built into the table at the dealer's position and at each player's position. All of the monitors are connected to a central (usually dedicated) computer processing unit normally which may also be built into the table. The software which runs on the processing unit and operates the play of the game is controlled from the dealer's monitor which includes a touch screen controller. The players' monitors can also have touch screens to communicate with the processor, but only for the purpose of indicating that a player wishes to bet or fold prior to a deal round. Preferably the players' monitor will be for viewing only and players will announce verbally at the table whether they are betting or folding prior to each deal, and after each player has verbally announced the dealer will enter any folds into the system via his/her touch screen and then activate the deal of the next card, also from the touch screen.

The biased dealing function is normally incorporated directly into the software which otherwise operates the play of the game, although separate biasing software which runs in parallel with the game-play software is also contemplated. As indicated above, specific software coding to accomplish the deal biasing can be readily determined, installed and operated by those skilled in the art. The biasing function will normally be present as part of steps 72 and 78 in FIGS. 14A/B, since it controls the specific cards to be dealt to the dealer and the players at each point in the hand. It is also contemplated that two or more different biasing methods may be utilized and included in the software. This would effectively allow the play of the poker games to be varied subtly, with different hands being played with different deal biasing in effect, so that players would need to alter their betting and playing strategies for the different hands. In variations on this, two or more different tables in a casino could be run using different deal biasing, so that players could play under the type of biasing they preferred by choosing which table to play at, or, at a single table, the games could be run under one biased dealing method for a specified period of time—such as one hour—and then switch to running under a difference method for a subsequent time period.

It will thus be seen that this game allows the players to win either by playing against the dealer or by playing against the other players or both. Not only does this feature of the invention make for a much more profitable game for players, but it also raises the players' interest in the progress of each hand since each player must consider not only the status of the other players' hands but also the dealer's hand in determining whether to bet, call, raise or fold on a particular round.

It will be evident that there are numerous embodiments of the present invention which, while not expressly set forth above, are clearly within the scope and spirit of the present invention. The scope of the invention is therefore to be determined solely by the appended claims and the embodiments described in the above specification are to be considered exemplary only.

We claim:

1. A method of playing a poker card game which comprises: providing a deck of playing cards;

designating a dealer who is dealt a hand of cards during play of a game but neither bets nor folds;

having said dealer also deal sequential cards as hands to a plurality of players, said players betting prior to at least one sequential deal, said betting by each said player being divided into a house bet placed against the dealer and a pool bet placed against other players;

conducting and completing play of said game according to rules of poker;

at the end of said game separately determining for each player the outcome of the player's hand against the dealer's hand and thereby determining the outcome of the player's house bet; and for all players completing the game also determining the relative rankings of the hands of said players and thereby determining the distribution of the pool bets accumulated during said game;

conducting each deal using a method of biasing to concentrate the values of hands dealt to all players in the game around an initial hand value and decrease the proportion of hands of significantly lower or higher rank than said initial hand value, which would otherwise result from non-biased dealing of said hand, whereby through the play of a single dealt hand a player may win a bet against the dealer and also a betting pool against other players participating in said game.

2. A method as in claim 1 wherein said accumulated pool is distributed entirely to a player with the highest ranking hand among said players upon completion of said game.

3. A method as in claim 2 further where distribution to said player is made only if said player's hand also ranks higher than said dealer's hand.

4. A method as in claim 1 further comprising limiting distribution of accumulated pool bets at the end of said game to only being among players whose hands ranked higher than said dealer's hand.

5. A method as in claim 4 wherein when no player has a hand upon completion of said game which outranks said dealer's hand, said accumulated pool is retained and incorporated into the players' pool of a next following game.

6. A method as in claim 1 further comprising distributing said accumulated pool among a plurality of said players.

7. A method as in claim 6 further comprising limiting distribution of accumulated pool bets at the end of said game to only being among players whose hands ranked higher than said dealer's hand.

8. A method as in claim 6 further comprising said distribution being done according to a predetermined schedule of shares.

9. A method as in claim 8 wherein said shares of said predetermined schedule are determined by relative rankings of players' hands.

10. A method as in claim 1 wherein said betting comprises an ante by each player prior to the initial deal and a bet by each remaining player prior to each successive deal.

11. A method as in claim 10 wherein said initial deal for said dealer and each player comprises two cards and each successive deal comprises one card.

12. A method as in claim 1 wherein each said deal is conducted using a method of biasing to concentrate the values of hands dealt to all players in the game around an initial hand value and decrease the proportion of hands of significantly lower or higher rank than said initial hand value, which would otherwise result from non-biased dealing of said hand.

13. A method as in claim 1 wherein said method of biasing of said deal comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

14. A method as in claim 13 wherein each said player is assigned as said deviation multiplier a number in the range of 0.1-4.0.

15. A method as in claim 14 wherein each said player is assigned as said deviation multiplier a number in the range of 0.5-3.5.

16. A method as in claim 15 wherein each said player is assigned as said deviation multiplier an integer 1, 2 or 3.

17. A method as in claim 13 wherein said range of possible hand rankings for a player is determined by the formula:

$$\text{Range}=(\text{Initial single hand rank})\times\pm(N\times\text{the player's deviation multiplier})$$

wherein N is a number in the range of 5.0-15.0.

18. A method as in claim 17 wherein N is a number in the range of 8.0-12.0.

19. A method as in claim 18 wherein N is the integer 10.

20. A method as in claim 1 comprising providing a plurality of different said methods of biasing and using different ones of said methods of biasing for different individual games during play of a series of said games.

21. A method as in claim 1 wherein a player who folds during play of a game forfeits the player's house bet and pool bet.

22. A method as in claim 1 wherein a player who declines to place a pool bet initially or in a subsequent round of betting forfeits the player's placed pool bets but continues to play against the dealer.

23. Apparatus for play of a poker game, said apparatus comprising:

a poker table having positions for a dealer and a plurality of players;

a computer processing unit having loaded therein operating software which establishes and controls the play of said game;

a dealer's monitor incorporated into said table at said dealer's position and comprising a touch screen for communication with said computer and software, said monitor having a screen which is visible to said dealer and all of said players;

players' monitors incorporated in said at each of said players' positions, each said monitor having a screen which is visible to said dealer and all of said players;

means controlled by said dealer's touch screen for dealing a simulated hand of cards to said dealer and each said player and displaying said hand for said dealer and each said player on the respective player's or dealer's monitor screen;

means controlled by said dealer's touch screen for dealing said hands as a sequence of deals of individual cards with intervals therebetween for players to place house bets against the dealer and pool bets against the other players; and means for comparing the relative rankings of all said hands and displaying on respective monitor screens the final status of each player's hand with respect to said house bet against the dealer and said pool bets against other players, wherein said software comprises means for biasing deal of cards to said players and dealer which comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

24. Apparatus as in claim 23 further comprising indicia appearing on said table adjacent to each players position for indicating where said player is to place each house bet against the dealer and each pool bet against the other players.

25. Apparatus as in claim 24 further comprising indicia appearing on said table for indication of a location for accumulation of players' pool bets constituting a pot.

26. Apparatus as in claim 25 wherein said location is adjacent to said dealer's position.

27. Apparatus as in claim 23 further comprising, for a player who folds during the course of a game being played, means for displaying indicia identifying said folder player on said player's monitor screen and also on the dealer's monitor screen.

28. Apparatus as in claim 23 wherein said software comprises means for dealing a predetermined number of cards upon activation of a DEAL command by said dealer at appropriate intervals in the play of a hand.

29. Apparatus as in claim 28 further wherein said software comprises means for determining the number of cards dealt and number remaining to be dealt at each point during the hand and the number of players remaining active in the hand at each point during the game, and for dealing subsequent cards according only to active players.

30. Apparatus as in claim 23 wherein said software comprises means for determining, upon completion of a hand, the status of each player with respect to the player's having folded or having won or lost against the dealer and other players, and for displaying indicia showing such status on the dealer's screen and on each respective player's screen.

31. Apparatus as in claim 23 wherein said software comprises means for biasing deal of cards to said players and dealer which comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

32. Apparatus as in claim 23 wherein said range of possible hand rankings for a player is determined by the formula:

$$\text{Range}=(\text{Initial single hand rank})\times\pm(N\times\text{the player's deviation multiplier})$$

wherein N is a number in the range of 5.0-15.0.

33. Apparatus as in claim 23 further comprising a router for electronic interconnection of said processing unit and said monitors.

34. Apparatus as in claim 23 further comprising a general purpose computer interconnected with said processing unit for installation, observation, revision, upgrading or removal of said software loaded in said processing unit.

35. Apparatus for play of a poker game comprising:

a poker table having positions for a dealer and a plurality of players;

a computer processing unit having loaded therein operating software which establishes and controls the play of said game;

a dealer's monitor incorporated into said table at said dealer's position and comprising a touch screen for communication with said computer and software, said monitor having a screen which is visible to said dealer and all of said players;

players' monitors incorporated in said at each of said players' positions, each said monitor having a screen which is visible to said dealer and all of said players;

means controlled by said dealer's touch screen for dealing a simulated hand of cards to said dealer and each said player and displaying said hand for said dealer and each said player on the respective player's or dealer's monitor screen;

means controlled by said dealer's touch screen for dealing said hands as a sequence of deals of individual cards with intervals therebetween for players to place house bets against the dealer and pool bets against the other players; and means for comparing the relative rankings of all said hands and displaying on respective monitor screens the final status of each player's hand with respect to said house bet against the dealer and said pool bets against other players, wherein said software comprises means for biasing deal of cards to said players and dealer which comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

36. Apparatus as in claim 35 further comprising indicia appearing on said table adjacent to each player's position for indicating where said player is to place each house bet against the dealer and each pool bet against the other players.

37. Apparatus as in claim 35 further comprising indicia appearing on said table for indication of a location for accumulation of players' pool bets constituting a pot.

38. Apparatus as in claim 37 wherein said location is adjacent to said dealer's position.

39. Apparatus as in claim 35 further comprising, for a player who folds during the course of a game being played, means for displaying indicia identifying said folder player on said player's monitor screen and also on the dealer's monitor screen.

40. Apparatus as in claim 35 wherein said software comprises means for dealing a predetermined number of cards upon activation of a DEAL command by said dealer at appropriate intervals in the play of a hand.

41. Apparatus as in claim 40 further wherein said software comprises means for determining the number of cards dealt and number remaining to be dealt at each point during the hand and the number of players remaining active in the hand at each point during the game, and for dealing subsequent cards according only to said active players.

42. Apparatus as in claim 35 wherein said software comprises means for determining, upon completion of a hand, the status of each said player with respect to the player's having folded or having won or lost against said dealer and other players, and for displaying indicia showing such status on the dealer's screen and on each respective player's screen.

43. Apparatus as in claim 35 wherein said software comprises means for biasing deal of cards to said players and dealer which comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

44. Apparatus as in claim 35 wherein said range of possible hand rankings for a player is determined by the formula:

$$\text{Range}=(\text{Initial single hand rank})\times\pm(N\times\text{the player's deviation multiplier})$$

wherein N is a number in the range of 5.0-15.0.

45. Apparatus as in claim 35 further comprising a router for electronic interconnection of said processing unit and said monitors.

46. Apparatus as in claim 35 further comprising a general purpose computer interconnected with said processing unit for installation, observation, revision, upgrading or removal of said software loaded in said processing unit.

47. A computer program embodied on a computer readable medium which, when executed, enables a computer to perform a method of playing a poker game that uses a predetermined set of rules to determine a winning or losing outcome comprising the steps of:

recognizing a dealer and causing a hand of cards to be dealt to said dealer during play of a game, but not permitting said dealer to fold said hand;

recognizing at least one player and causing said dealer to deal sequential cards as a hand to said player;

conducting and completing play of said game according to rules of poker;

at the end of said game separately determining for said at least one player the outcome of the player's hand against the dealer's hand; and for all players completing the game also determining the relative rankings of the hands of said players, and wherein each said deal is conducted using a method of biasing to concentrate the values of hands dealt to all players in the game around an initial hand value and decrease the proportion of hands of significantly lower or higher rank than said initial hand value, which would otherwise result from non-biased dealing of said hand.

48. The computer program as in claim 47 comprising functionality to:

recognize each player of a plurality of players;

deal said hands to players in said plurality in a sequential manner consistent with said rules of poker;

recognize if any said player withdraws from play during said game; and thereafter adjusting said sequential manner of said deal to said players to account for said player's withdrawal from play.

49. The computer program as in claim 47 wherein each said deal is conducted using a method of biasing to concentrate the values of hands dealt to all players in the game around an initial hand value and decrease the proportion of hands of significantly lower or higher rank than said initial hand value, which would otherwise result from non-biased dealing of said hand.

50. The computer program as in claim 47 further comprising means for biasing deal of cards to said players and dealer which comprises first selecting as an initial single hand rank a first random number between 1 and the number of possible hands, assigning a deviation multiplier to each player in said game, utilizing said initial single hand rank with said deviation multiplier to determine a range of possible hand rankings for each of said players in the card game, and then dealing each said player a hand within said range of hand rankings for said player.

51. The computer program as in claim 50 wherein said range of possible hand rankings for a player is determined by the formula:

$$\text{Range}=(\text{Initial single hand rank})\times\pm(N\times\text{the player's deviation multiplier})$$

wherein N is a number in the range of 5.0-15.0.

52. The computer program in claim 47 further comprising a plurality of different methods of biasing and using different ones of said methods of biasing for different individual games during play of a series of said games.

* * * * *